US009199756B2

(12) United States Patent
Cooper

(10) Patent No.: US 9,199,756 B2
(45) Date of Patent: Dec. 1, 2015

(54) FASTENER STOCK AND DEVICE FOR USE IN DISPENSING PLASTIC FASTENERS THEREFROM

(75) Inventor: William J. Cooper, Natick, MA (US)

(73) Assignee: Avery Dennison Corporation, Glendale, CA (US)

( * ) Notice: Subject to any disclaimer, the term of this patent is extended or adjusted under 35 U.S.C. 154(b) by 967 days.

(21) Appl. No.: 13/304,856

(22) Filed: Nov. 28, 2011

(65) Prior Publication Data

US 2013/0134205 A1 May 30, 2013

(51) Int. Cl.

| | |
|---|---|
| ***B65C 7/00*** | (2006.01) |
| ***G09F 3/14*** | (2006.01) |
| *A41H 37/00* | (2006.01) |

(52) U.S. Cl.

CPC ..... *B65C 7/003* (2013.01); *B65C 7/008* (2013.01); *G09F 3/14* (2013.01); *A41H 37/008* (2013.01); *Y10T 24/4691* (2015.01)

(58) Field of Classification Search

CPC ..... B27F 7/21; A43D 69/04; A43D 69/02; B65C 7/003; B65C 7/005; A41H 37/008; G09F 3/14

USPC ..... 227/97–98, 73

See application file for complete search history.

(56) References Cited

U.S. PATENT DOCUMENTS

| | | | | |
|---|---|---|---|---|
| 4,039,078 | A * | 8/1977 | Bone | 206/343 |
| 4,111,347 | A * | 9/1978 | Bone | 227/68 |
| 4,456,123 | A | 6/1984 | Russell | |
| 4,592,499 | A | 6/1986 | Kato | |
| 5,020,713 | A | 6/1991 | Kunreuther | |
| 5,038,931 | A * | 8/1991 | Kunreuther | 206/346 |
| 5,205,458 | A | 4/1993 | Kunreuther | |
| RE34,857 | E | 2/1995 | Kunreuther | |
| RE34,858 | E | 2/1995 | Kunreuther | |
| RE34,891 | E | 4/1995 | Kunreuther | |

(Continued)

FOREIGN PATENT DOCUMENTS

| | | |
|---|---|---|
| CN | 1094366 | 11/1994 |
| CN | 1191197 | 8/1998 |

(Continued)

OTHER PUBLICATIONS

International Search Report and Written Opinion dated Dec. 17, 2012 for International Application No. PCT/US2011/062187.

*Primary Examiner* — Andrew M Tecco

(74) *Attorney, Agent, or Firm* — Avery Dennison Retail Information Services LLC

(57) ABSTRACT

A device for dispensing a plastic fastener from a supply of ladder-type fastener stock includes a pair of separate modules that are independently pneumatically powered by a common air source. Each module is adapted to receive and index a corresponding side rail of the fastener stock, separate a cross-bar therefrom and eject the separated cross-bar out through a sharpened needle. As a feature of the invention, the pair of modules ejects the cross-bars of the dispensed fastener in an offset relationship to minimize fastener stress. As another feature of the invention, the pair of modules is independently slidably coupled to a common mounting plate. In this manner, the spacing and angular orientation between the modules are adjustable. As another feature of the invention, the feed mechanism includes a feed pawl that selectively engages outwardly facing notches formed in the side rail to ensure accurate alignment prior to the severing process.

11 Claims, 19 Drawing Sheets

(56) References Cited

U.S. PATENT DOCUMENTS

| | | | | |
|---|---|---|---|---|
| 5,579,976 | A * | 12/1996 | Kunreuther et al. | 227/71 |
| 5,615,816 | A * | 4/1997 | Deschenes et al. | 227/71 |
| 5,678,747 | A | 10/1997 | Kunreuther | |
| 5,755,371 | A | 5/1998 | Huang | |
| 5,810,238 | A | 9/1998 | Kunreuther | |
| 5,950,901 | A | 9/1999 | Kubota | |
| 6,561,405 | B2 * | 5/2003 | Flannery et al. | 227/67 |
| 6,561,406 | B1 | 5/2003 | Furutsu | |
| 6,732,899 | B2 * | 5/2004 | Franks | 227/107 |
| 7,036,680 | B1 * | 5/2006 | Flannery | 221/74 |
| 7,444,922 | B2 | 11/2008 | Harashima et al. | |
| 8,413,866 | B2 * | 4/2013 | Cooper et al. | 227/67 |
| 8,657,172 | B2 * | 2/2014 | Cooper | 227/67 |
| 2003/0218043 | A1 * | 11/2003 | Cooper et al. | 227/67 |
| 2008/0164271 | A1 * | 7/2008 | Cooper et al. | 221/1 |
| 2008/0190956 | A1 * | 8/2008 | Earley et al. | 221/74 |

FOREIGN PATENT DOCUMENTS

| | | |
|---|---|---|
| CN | 2478931 | 2/2002 |
| CN | 2478932 | 2/2002 |
| CN | 1341539 | 3/2002 |
| CN | 2513732 | 10/2002 |
| CN | 1408619 | 4/2003 |
| CN | 2550270 | 5/2003 |
| CN | 2567156 | 8/2003 |
| CN | 1457311 | 11/2003 |
| CN | 200964193 | 10/2007 |
| CN | 101104983 | 1/2008 |
| CN | 101184668 | 5/2008 |
| CN | 201087255 | 7/2008 |
| CN | 201089535 | 7/2008 |
| CN | 201115438 | 9/2008 |
| CN | 101362521 | 2/2009 |
| CN | 101450719 | 6/2009 |
| CN | 101628637 | 1/2010 |
| CN | 101734392 | 6/2010 |
| CN | 201619718 | 11/2010 |
| CN | 201633970 | 11/2010 |
| CN | 201712833 | 1/2011 |
| CN | 201751304 | 2/2011 |
| CN | 102046475 | 5/2011 |
| CN | 201849699 | 6/2011 |
| DE | 2805034 | 8/1979 |
| DE | 3115112 | 4/1982 |
| DE | 3213933 | 11/1982 |
| DE | 3512747 | 10/1985 |
| DE | 19748592 | 5/1999 |
| EP | 0888727 | 1/1999 |
| WO | 9410044 | 5/1994 |

* cited by examiner

FASTENER STOCK AND DEVICE FOR USE IN DISPENSING PLASTIC FASTENERS THEREFROM

FIELD OF THE INVENTION

The present invention relates generally to plastic fasteners and more particularly to devices used in the dispensing of plastic fasteners.

BACKGROUND OF THE INVENTION

Plastic fasteners (also commonly referred to in the art as plastic attachments) are well known in the art and commonly used to couple articles of commerce to packaging, buttons to fabric, merchandising tags to articles of commerce, or, in general, any two desired articles. One type of plastic fastener which is widely used in commerce is manufactured in an H-shaped configuration, with two shortened parallel cross-bars, or T-bars, interconnected at their approximate midpoints by a thin, flexible filament that extends orthogonally therebetween.

Plastic fasteners of the type described above are commonly fabricated as part of continuously connected fastener stock that is produced from one or more flexible plastic materials, such as nylon and polypropylene, using conventional molding or stamping techniques. Referring now to FIG. 1, there is shown a length of continuously connected fastener stock 11 that is well known in the art. Fastener stock 11 is formed from two elongated and continuous plastic side members, or rails, 13 and 15 that are interconnected by a plurality of equidistantly spaced cross-links, or filaments, 17. Due its ladder-like appearance, fastener stock 11 is also commonly referred to as ladder-type fastener stock, or ladder stock, in the art.

By severing each of side rails 13 and 15 at the approximate midpoint between successive filaments 17, a plurality of individual plastic fasteners 18 can be produced from ladder stock 11. Each plastic fastener 18 produced from ladder stock 11 comprises a pair of cross-bars 19 and 21 that are interconnected by a thin, flexible filament 23, with cross-bars 19 and 21 being derived from side rails 13 and 15, respectively, and filament 23 being derived from a corresponding cross-link 17. Ladder stock of the type described above is shown in U.S. Pat. No. 4,039,078 to A. R. Bone and U.S. Pat. No. 5,615,816 to C. L. Deschenes, the disclosures of both patents being incorporated herein by reference.

Ladder stock of the type described above is presently manufactured and sold by Avery Dennison™ Corporation of Pasadena, Calif. under the Plastic Staple® and Elastic Staple™ lines of plastic fasteners. The commercialized ladder stock is traditionally wound onto a reel, or spool, which is sized and shaped to hold a supply of ladder stock that yields approximately 25,000 fasteners.

Either manually or with the aid of specifically designed devices, individual fasteners are commonly severed from a supply of ladder stock and, in turn, dispensed in order to secure together two or more items. For example, in commonly assigned U.S. Pat. No. 7,036,680 to Steven E. Flannery, which is incorporated herein by reference, there is disclosed a pneumatically driven device for dispensing individual plastic fasteners from a reel of continuously connected ladder stock. The device includes a protective outer housing and a pair of hollow slotted needles that protrude out from one end of the housing in a parallel relationship, each needle having a rear end, a longitudinal bore and a sharpened tip adapted to penetrate through the items to be fastened. The device also includes a feed mechanism that relies upon a pair of rotatable feed wheels to engage selected cross-links of the ladder stock so as to advance the side rails into direct axial alignment behind the longitudinal bores defined by the pair of needles. With each side rail positioned directly behind a corresponding needle, a pair of articulating sharpened knife blades is actuated so as to cut the side rails of the ladder stock at the approximate midpoint between successive cross-links and thereby separate an individual plastic fastener from the remainder of the ladder stock. The device further includes an ejection mechanism disposed within the interior cavity of the housing that ejects the cross-bars of the severed fastener out through the pair of hollowed needles and, in turn, through the intended items. The ejection mechanism includes an ejector rod slide, or carriage, that is pneumatically driven by a single air cylinder to travel back and forth within the protective housing. The ejector rod slide supports a pair of parallel ejector rods, each ejector rod being dimensioned and positioned to selectively penetrate through a corresponding needle in order to eject an associated cross-bar of the severed fastener out therefrom.

As noted briefly above, fasteners of the type as described above are commonly used in a wide variety of different applications to secure together two or more items. For example, fasteners of the type described above are commonly used in packaging applications to secure an article of commerce to a display card. As part of the attachment process, the display card is first positioned on an anvil for the fastener dispensing machine. Next, the article of commerce is placed in its desired location on the display card. The machine is then downwardly displaced until the pair of needles penetrates through the display card on opposite sides of the article of commerce and in close proximity relative thereto. As a fastener is severed from the fastener stock and subsequently ejected through the hollow needles, each of the pair of cross-members engages the underside of the card with the thin filament stretching tightly across the front of the article. In this capacity, the dispensed fastener serves to secure the article to the display card in an inconspicuous and unobtrusive manner.

In certain applications, it has been found to be desirable to modify the spacing between the pair of needles for fastener dispensing devices of the type described above. For instance, adjusting the spacing between needles is often required to accommodate supplies of ladder stock with cross-links of varying lengths (e.g., between 0.25 inches and 0.38 inches). In addition, adjusting the spacing between needles is often required to account for variances in the size and shape of articles that are commonly joined using plastic fasteners (e.g., items of different widths that are secured to display cards).

Accordingly, fastener dispensing devices with variable needle spacing are known in the art and are commonly referred to as variable needle system (VNS) devices or VNS modules. One well known type of VNS device includes a pair of needle mounts, or blocks, each of which is shaped to include a bore dimensioned to fittingly receive a corresponding needle. As part of its design, one needle block for the VNS device is held fixed in place and the other needle block is mounted on a laterally disposed axle and is thereby capable of displacement towards and/or away from the fixed needle block through rotation of a spacing wheel. In this manner, the spacing between the pair of needle blocks and, in turn, the needles mounted thereon, can be adjusted through rotation of the spacing wheel.

Although well known in the art, fastener dispensing devices with variable needle spacing capabilities typically suffer from a few notable shortcomings.

As a first shortcoming, fastener dispensing devices of the type described above are traditionally constructed as selfcontained, modular units. As a result, the spacing range between needles is generally limited by the length of the axle on which the movable needle block is mounted and, more generally, by the overall width of the VNS module housing. As can be appreciated, it has been found that this restriction on the maximum spacing between needles precludes use of traditional VNS devices in certain larger-scale packaging applications (e.g., in securing larger sized objects to display cards), which is highly undesirable.

As a second shortcoming, fastener dispensing devices of the type described above exert a significant amount of stress on each fastener during the ejection process which, in turn, can lead to inadvertent breakage of the fastener, which is highly undesirable. Specifically, it has been found that as each cross-bar is ejected, the fastener is temporarily stretched to the extent necessary so that the cross-bar can exit out through the tip of its corresponding needle. Once each cross-bar exits its corresponding needle, the temporary stretching force applied to the fastener by the ejector rods and the stress resulting therefrom is withdrawn. However, because traditional fastener dispensing devices are designed to simultaneously eject both cross-bars of the same fastener through their corresponding needles (i.e., with the cross-bars ejected in phase with one another), the cumulative effect of the temporary stress applied to the fastener often results in fastener breakage during the ejection process.

As a third shortcoming, fastener dispensing devices of the type described above include a feed mechanism that engages one or more cross-links in order to advance the ladder stock into position for severing of the lowermost fastener. However, it is to be understood that the feed mechanism typically engages cross-links that are significantly behind the lowermost cross-link (i.e., the cross-link for the fastener to be separated from the remainder of the ladder stock). As a consequence, a considerable amount of misalignment, or drift, of the lowermost cross-links within the device is experienced prior to the side rail cutting process. Ladder stock drift in turn causes the device to cut each side rail at a location away from the exact midpoint between successive fasteners, thereby resulting in fasteners that fail to have the optimal H-shaped configuration. In response thereto, a considerable degree of user adjustment is often required in order to maintain accurate and consistent cutting of side rails, which is both labor-intensive and often unreliable.

As a fourth shortcoming, fastener dispensing devices of the type described above utilize a relatively complex locking mechanism to releasably retain each sharpened needle within its corresponding needle block. Specifically, as noted briefly above, each needle is fittingly inserted into a bore formed into its corresponding needle block. To secure each needle within its corresponding bore, a needle lock screw is ratably driven transversely through each needle block and into selective engagement within a scallop formed in the base of its associated needle. As a consequence, it to be understood that the process for removing, repairing and/or replacing needles is not only labor-intensive and time-consuming but also requires the use of an additional tool, such as a screwdriver, which is highly undesirable.

BRIEF SUMMARY OF THE INVENTION

It is an object of the present invention to provide a new and improved supply of fastener stock.

It is another object of the present invention to provide fastener stock as described above that is shaped to include a pair of elongated and continuous side rails to which are coupled a plurality of equidistantly spaced filaments.

It is yet another object of the present invention to provide a new and improved device for use in dispensing plastic fasteners from the supply of fastener stock described above.

It is still another object of the present invention to provide a device as described above that includes a pair of hollow needles adapted to penetrate through one or more items, at least one feed mechanism for advancing each rail of the supply of fastener stock into axial alignment behind a corresponding hollow needle, at least one severing mechanism for severing from the fastener stock a fastener to be dispensed through the pair of needles, and at least one ejection mechanism for ejecting the cross-bars of the severed fastener through the hollow needles and, in turn, the one or more penetrated items.

It is yet still another object of the present invention to provide a fastener dispensing device that limits the amount of stress exerted on each fastener during its ejection out through the pair of hollow needles.

It is another object of the present invention to provide a fastener dispensing device as described above that allows for enhanced flexibility in modifying the spacing between the pair of needles, thereby enabling the device to be used in a wider range of potential applications.

It is yet another object of the present invention to provide a device as described above that reliably feeds the fastener stock into proper alignment behind the pair of hollow needles prior to the rail severing process.

It is still another object of the present invention to provide a device as described above that includes a hand-operable mechanism for releasably retaining each needle in place therein.

Accordingly, as one feature of the present invention, there is provided a supply of fastener stock, the supply of fastener stock comprising (a) a first side rail, (b) a second side rail spaced apart from the first side rail, and (c) a plurality of cross-links extending transversely between and interconnecting the first and second side rails, (d) wherein each of the first and second side rails is shaped to include a notch, the notches on the first and second side rails facing away from each other.

It is another object of the present invention to provide paddle fastener stock as described above that is shaped to include a longitudinal and continuous side member and a plurality of paddles to which are coupled to a plurality of equidistantly spaced cross-pieces. The longitudinal and continuous side member and paddle heads are extended in a parallel spaced relationship, and the series of cross-pieces are arranged at spaced intervals between the side member and paddle heads so as to connect the side member and paddle heads. The longitudinal and continuous side member, paddle heads, and the cross-pieces both have a flat side. Along the side member, a series of engagement notches are present at spaced intervals between each of said cross-pieces members, and the engagement notches are rectangular or square in shape.

As another feature of the present invention, there is provided a device for dispensing a plastic fastener from a supply of fastener stock, the fastener stock being shaped to include a pair of continuous side rails to which are coupled a plurality of transverse cross-links, each fastener including a pair of cross-bars that are interconnected by at least one thin filament, the device comprising (a) a first module adapted to dispense one of the pair of cross-bars for the fastener, and (b) a second module adapted to dispense the other of the pair of cross-bars for the fastener, (c) wherein the first and second modules are separate from one another.

As another feature of the present invention, there is provided a device for dispensing a plastic fastener, the plastic fastener including a pair of cross-bars that are interconnected by at least one thin filament, the device comprising (a) a first needle shaped to define a longitudinal bore, (b) a first ejector rod adapted to axially penetrate through the longitudinal bore in the first needle and eject one of the pair of cross-bars out therefrom, (c) a second needle shaped to define a longitudinal bore, and (d) a second ejector rod adapted to axially penetrate through the longitudinal bore in the second needle and eject the other of the pair of cross-bars out therefrom, (e) wherein the first and second ejector rods operate in an offset relationship.

As another feature of the present invention, there is provided a module for dispensing an individual plastic fastener from a supply of fastener stock, the fastener stock being shaped to include a continuous side rail to which is coupled a plurality of cross-links, the continuous side rail being shaped to include a notch, the individual plastic fastener including a filament coupled at one end to a cross-bar, the module comprising (a) a housing, (b) a needle coupled to the housing, the needle being shaped to define a longitudinal bore, (c) a feed mechanism adapted to selectively engage the notch and advance the side rail into direct axial alignment behind the longitudinal bore of the needle, (d) a severing mechanism adapted to cut the side rail to separate a first cross-bar therefrom, and (e) an ejection mechanism adapted to urge the first cross-bar through the longitudinal bore in the needle.

As another feature of the present invention, there is provided a module for dispensing an individual plastic fastener from a supply of fastener stock, the fastener stock being shaped to include a continuous side rail to which is coupled a plurality of cross-links, the individual plastic fastener including a filament coupled at one end to a cross-bar, the module comprising (a) a housing, (b) a needle coupled to the housing, the needle being shaped to define a continuous longitudinal bore, (c) a needle holder coupled to the housing, the needle holder being shaped to define a slotted receptacle that is dimensioned to receive the needle, (d) a pivotable needle lock that is fixedly connected to the housing and adapted to selectively engage the needle, (e) a feed mechanism adapted to advance the continuous side rail into direct axial alignment behind the longitudinal bore of the needle, (f) a severing mechanism adapted to cut the continuous side rail to separate a first cross-bar therefrom, and (g) an ejection mechanism adapted to urge the first cross-bar through the longitudinal bore in the needle.

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which:

FIG. 3(*d*) is a perspective view of a length of continuously connected paddle fastener stock;

FIG. 3(*e*) is a perspective illustration of a paddle fastener cut from the paddle fastener stock;

DETAILED DESCRIPTION OF THE INVENTION

The apparatuses and methods disclosed in this document are described in detail by way of examples and with reference to the figures. Unless otherwise specified, like numbers in the figures indicate references to the same, similar, or corresponding elements throughout the figures. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be, and should not be, construed as mandatory or limiting unless specifically designated as such. Selected examples of apparatuses and methods are hereinafter disclosed and described in detail with reference made to the figures.

Fastener Stock 111

Figure 2:
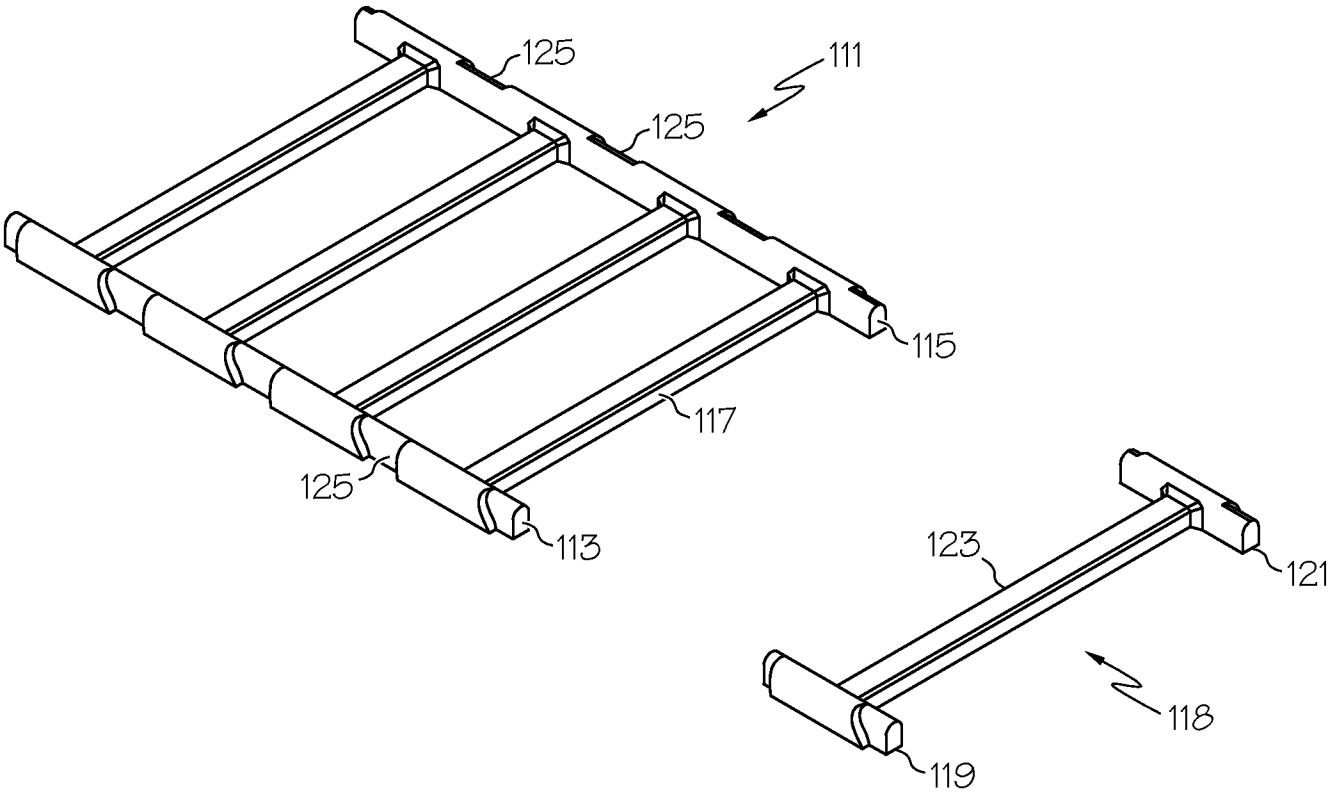
FIG. 2 depicts a front perspective view of a length of continuously connected fastener stock that is constructed according to the teachings of the present invention, the fastener stock being shown with a single fastener separated therefrom.
Figure 3A:
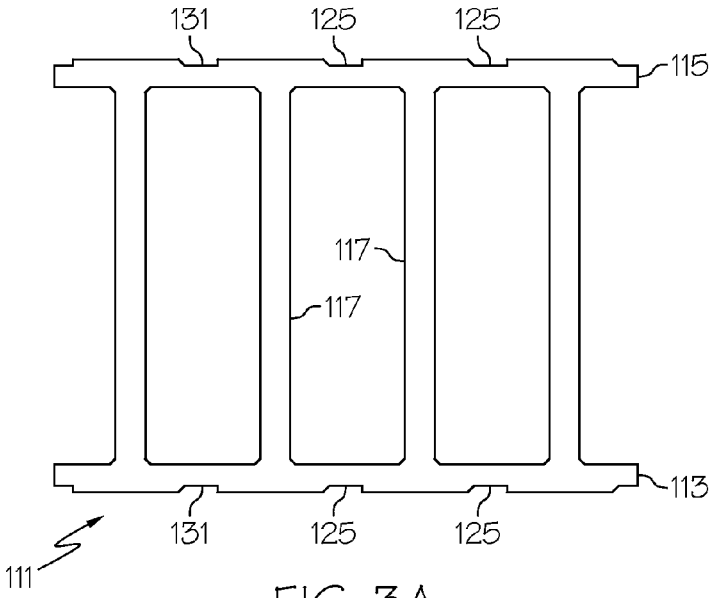
FIGS. 3(*a*)-(*c*) are front, bottom and left side views, respectively, of the continuously connected fastener stock shown in FIG. 2.
Figure 3B:
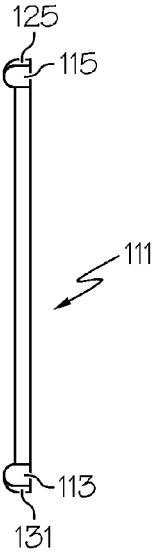
Figure 3C:
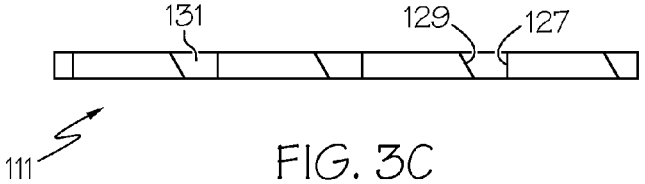
Figure 3D:
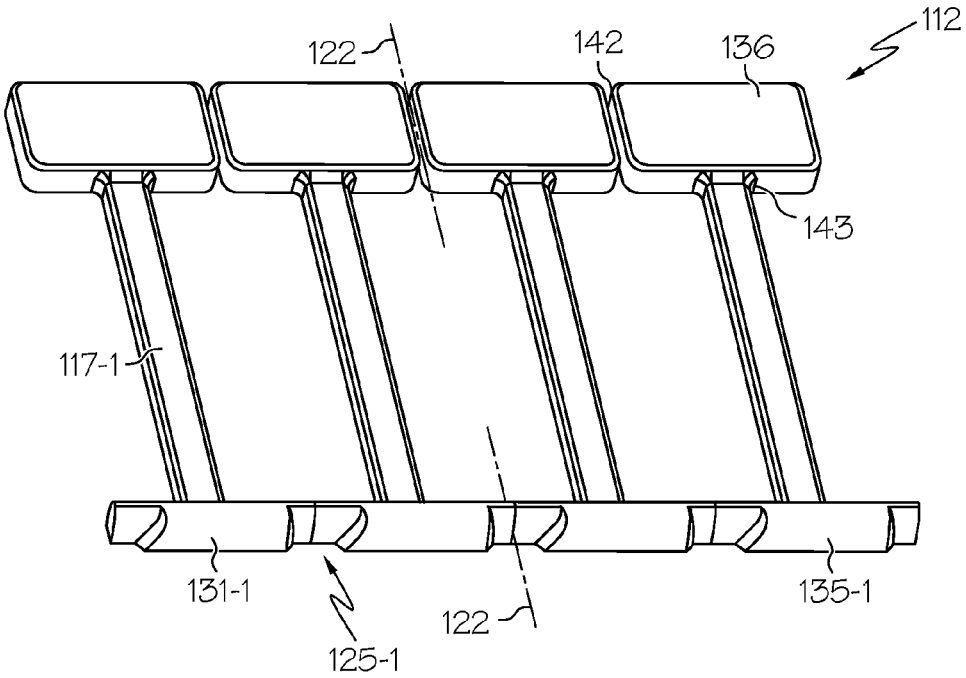
Figure 3E:
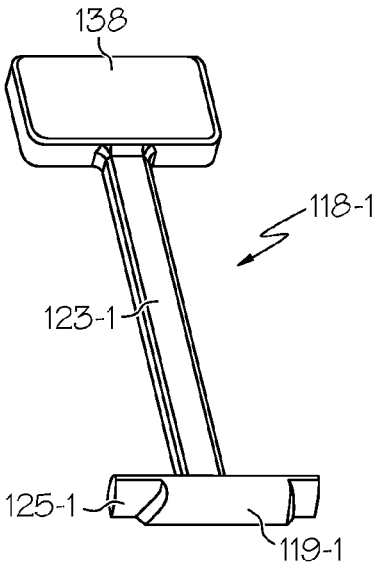

Referring now to FIGS. 2 and 3(*a*)-(*c*), there is shown a length of continuously connected fastener stock that is constructed according to the teachings of the present invention and identified generally by reference numeral 111. As can be seen, fastener stock 111 is similar to conventional fastener stock 11 in that fastener stock 111 is formed from two elongated and continuous plastic side members, or rails, 113 and 115 that are interconnected by a plurality of equidistantly spaced cross-links, or filaments, 117. By severing each of side rails 113 and 115 at the approximate midpoint between successive filaments 117, a plurality of individual plastic fasteners 118 can be produced from ladder-type fastener stock 111. Each plastic fastener 118 produced from fastener stock 111 comprises a pair of cross-bars 119 and 121 that are interconnected by a thin, flexible filament 123, with cross-bars 119 and 121 being derived from side rails 113 and 115, respectively, and filament 123 being derived from a corresponding cross-link 117.

As seen most clearly in FIG. 2, the transverse cross-section of each of side rails 113 and 115 is generally in the form of a flattened semi-ellipse, or flattened semi-oval, that includes a generally flat bottom surface, opposing inner and outer surfaces that are generally flat, and a rounded top surface that together create a D-shaped profile. However, it is to be understood that the transverse cross-section of each of side rails 113 and 115 could be modified without departing from the spirit of the present invention.

Fastener stock 111 differs principally from prior art fastener stock 11 in fastener stock 111 includes a series of equidistantly spaced apart notches 125 formed into the flattened outer surface of each of rails 113 and 115. As seen most clearly in FIG. 3(*a*), notches 125 are dimensioned and arranged within each of rails 113 and 115 so as to align between successive filaments 117. As can be appreciated, notches 125 serve as engagement surfaces, or angular facings, that are used by a complementarily designed fastener dispensing device for reliably indexing fastener stock 111 into position prior to severing individual fasteners 118 therefrom, the details of the complementary fastener dispensing device to be described in detail below.

As seen most clearly in FIG. 3(*c*), each notch 125 has a generally trapezoidal profile and includes a near vertical, leading engagement surface 127 and an angled rear release surface 129. As will be described further in detail below, engagement surface 127 serves as the contact region on which the indexing mechanism for the complementary fastening dispensing device engages and advances fastener stock 111 into position for subsequent cutting of rails 113 and 115. Release surface 129 is designed with a greater slope (i.e., to extend at a less vertical angle) to assist in releasing fastener stock 111 from the mold wheel (not shown) from which it is constructed.

As noted briefly above, notches 125 extend along the outer surfaces of rails 113 and 115 and thereby face away (i.e., in opposite directions) from one another. As seen most clearly in FIGS. 3(*a*) and 3(*b*), each notch 125 extends only partially in from its outer surface so as to form a flat, vertically extending interior wall 131 (i.e., each notch 125 extends in only a portion of the width of rails 113 and 115).

It should be noted that traditional fastener dispensing devices include a rotary feed wheel that is designed to engage one or more cross-links 17 and, in turn, advance fastener stock 11 into position for subsequent severing of side rails 13 and 15. As can be appreciated, this process has been found to be unreliable in producing consistent H-shaped fasteners 18. By comparison, the inclusion of indexing notches 125 enables the lowermost region of fastener stock 111 to be accurately and reliably advanced by its side rails 113 and 115 (rather than its cross-links 117) into proper position within a complementary fastener dispensing device for subsequent severing of side rails 113 and 115, which is a principal object of the present invention.

Additionally, while the fastener 18 of the present invention generally has been illustrated as the plastic staple, various plastic fasteners of other configurations such as paddle fasteners and loop fasteners can also be formed in accordance with the principles of the present invention.

FIG. 3(*d*) provides a perspective view of a length of continuously connected paddle fastener stock 112. The paddle fastener stock 112 includes one longitudinal and continuous side member, or rail, 131-1, a plurality of paddle heads 136, and plurality of equidistantly spaced cross-pieces 117-1. The paddle fastener stock 112 comprises a plurality of connected paddle fasteners 118-1 (FIG. 3(*e*))

The paddle heads 136 and the side member 131-1 are spaced apart and are parallel to one another. Along the side member 131-1, a series of engagement notches 125-1 generally will be formed. Each notch 125-1 will be formed at a location substantially corresponding to or in close proximity with an actual or desired cut location 122 for the paddle fastener 118-1 (FIG. 3(*e*)). The cut locations 122 on the side member 131-1 should be generally aligned or parallel with one another for consistent sized paddle fasteners 118-1 (FIG. 3(*e*)). The notches 125-1 will generally be on an outer side 135-1 of the side member 131-1, facing outward and away from the cross-pieces 117-1. The side member 131-1 can be of various lengths, intervals and thicknesses.

The paddle heads 136 are interconnected along a rectangular side portion 142. The paddle heads 136 are typically rectangular in shape and may have rounded or pointed corners. The paddle heads 136 are connected to the cross-piece 117-1 by attaching near a midpoint 143 along an inner wall 125-1 of the paddle head 136. The paddle heads 136 can be of various lengths, intervals and thicknesses.

The cross-pieces 117-1 extend between the side member 131-1 and the paddle heads 136, connecting the side member 131-1 and the paddle heads 136 together. The cross-pieces 117-1 are arranged at spaced intervals along the side member 131-1 and paddle heads 136. The cross-pieces 117-1 may be of a thinner or reduced cross-section as compared to the side member 131-1. Additionally, the desired approximate stretch range of the cross-pieces 117-1 can be varied depending upon the desired application of the paddle fastener 112 (FIG. 3(*e*)). The cross-pieces 117-1 can be of various lengths, intervals and thicknesses.

Referring to FIG. 3(*e*), the severed paddle fastener 118-1 is shown. By severing the side member 131-1 (FIG. 3(*d*)) and paddle heads 136 (FIG. 3(*d*)) at the cut locations 122 (FIG. 3(*d*)) near the notches 125-1 and between successive cross-pieces 117-1 (FIG. 3(*d*)), a plurality of individual plastic paddle fasteners 118-1 can be produced from the paddle fastener stock 112 (FIG. 3(*d*)). The paddle fastener 118-1 comprises a cross-bar 119-1 and a rectangular portion 138 that are interconnected by a thin, flexible filament 123-1. Cross-bar 119-1 is derived from side member 131-1 (FIG. 3(*d*)), and filament 123-1 is derived from a corresponding cross-piece 117-1 (FIG. 3(*d*)). The rectangular portion 138 is derived from the interconnected paddle heads 136 (FIG. 3(*d*)) along the rectangular side portion 142 (FIG. 3(*d*)). Depending upon the desired size, the paddle fastener 118-1 may consist of cross-bar 119-1 with notches 125-1 present.

A transverse cross-section of cross-bar 119-1, rectangular portion 138, and flexible filament 123-1 are generally in the form a flattened semi-ellipse, or flattened semi-oval, that includes a flat bottom surface on sides. This creates a D-shaped profile with opposing inner and outer surfaces that are generally flat with a rounded top surface. However, it is to be understood that the transverse cross-section of each of side member 131-1 (FIG. 3(*d*)) and cross-pieces 117-1 (FIG. 3(*d*)) could be modified without departing from the spirit of the present invention.

Figure 1:
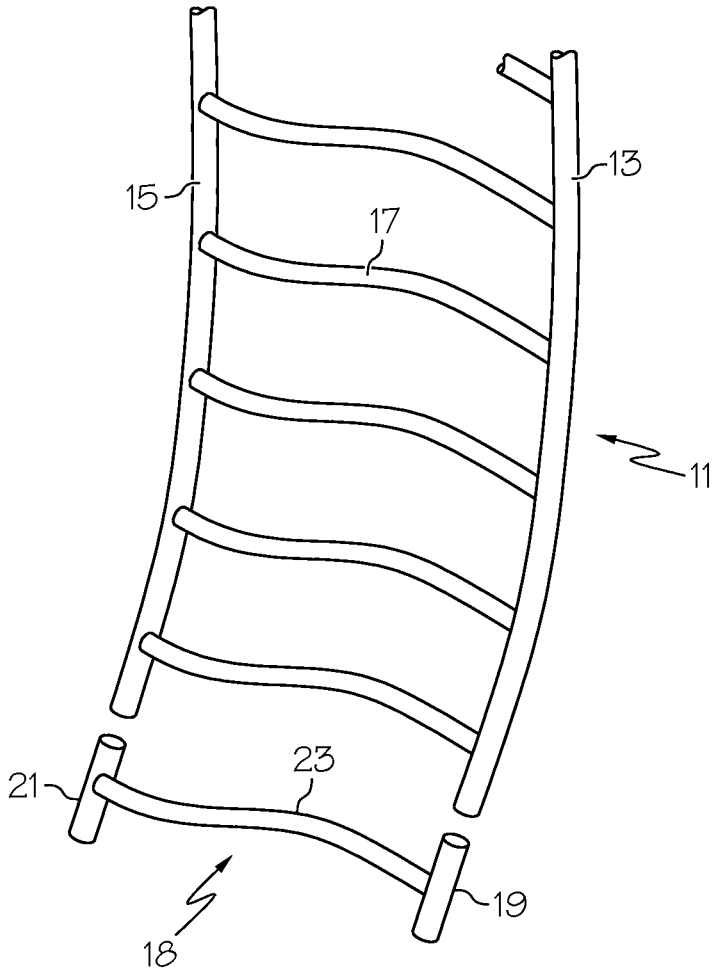
FIG. 1 (PRIOR ART)
FIG. 1 depicts a fragmentary, front perspective view of a length of continuously connected fastener stock that is well known in the art, the fastener stock being shown with a single fastener separated therefrom.

Similar to the fastener stock 16 (FIG. 1), the paddle fastener stock 112 (FIG. 3(*d*)) may be used by fastener dispensing systems.

Fastener Dispensing Device 211

Figure 4:
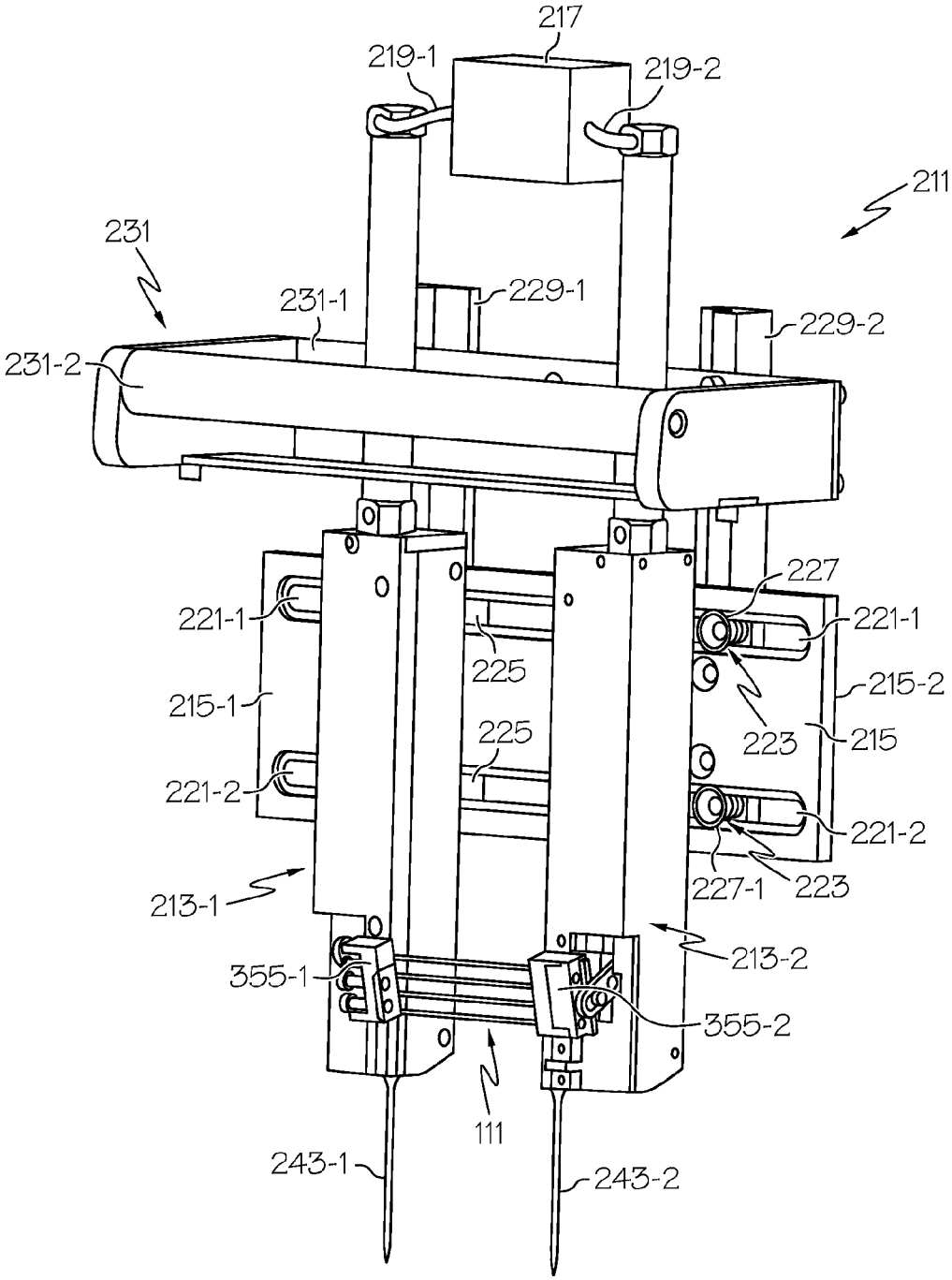
FIG. 4 is a front perspective view a device for dispensing individual plastic fasteners from a supply of continuously connected ladder stock, the device being constructed according to the teachings of the present invention and shown with the supply of continuously connected ladder stock of FIG. 2 fed thereinto.

Referring now to FIG. 4, there is shown a perspective view of a device for dispensing individual plastic fasteners from a supply of continuously connected ladder stock, the device being constructed according to the teachings of the present invention and identified generally by reference numeral 211. As will be described in detail below, device 211 is preferably designed to operate using ladder stock 111. However, it is to be understood that device 211 could be modified to operate using alternate styles of continuously connected fastener stock without departing from the spirit of the present invention.

Device 211 comprises first and second fastening dispensing modules 213-1 and 213-2 that are separately coupled to a common mounting plate 215. In addition, modules 213-1 and 213-2 are independently connected to a common air source, or supply, 217 by corresponding air tubes 219-1 and 219-2, respectively. Together, modules 213 are designed to dispense one or more fasteners 118 from fastener stock 111. As will be described in detail below, modules 2134 and 213-2 operate using completely independent indexing, severing and ejection mechanisms. As can be appreciated, the independent operation of modules 213-1 and 213-2 results in, among other things, limited stress imparted on each fastener 118 during the ejection process, which is a principal object of the present invention.

As noted briefly above, modules 213-1 and 213-2 are independently coupled to common mounting plate 215. In this manner, the spacing and angular orientation of modules 213 can be modified to allow device 211 to be used in a wide variety of potential applications, as will be described further in detail below.

Mounting plate 215 is represented herein as being in the form of a generally rectangular plate that is constructed of a rigid and durable material, such as metal. Plate 215 includes a substantially flat front surface 215-1 and a substantially flat rear surface 215-2. Mounting plate 215 is additionally shaped to define a pair of spaced apart slot-shaped openings 221-1 and 221-2 that extend horizontally in a generally parallel relationship.

A plurality of slides 223 is retained within slots 221, with a first pair of slides 223 located within upper slot 221-1 and a second pair of slides 223 located within lower slot 221-2. Each slide 223 is designed to travel linearly within its corresponding slot 221 and preferably includes an outwardly protruding tab, or stop, 225 at one end and an enlarged spool-shaped roller, or washer, 227 at its opposite end. Although not shown herein, each slide 223 is shaped to include a circular hole through which a fastening element can be inserted and, in turn, driven into threaded engagement with the outer housing for a corresponding module 213. In this manner, each module 213 is connected common mounting plate 215 through slides 223.

Preferably, each roller 227 can be locked in place within its corresponding slot 221 by inserting and tightening a fastening element through its central threaded bore (e.g., using a screwdriver or other similar tool). Specifically, tightening of the fastening element draws the enlarged front portion 227-1 of roller 227 into frictional engagement with the periphery of the particular slot 221 in which it is located. In this manner, by adjusting and locking the position of slides 223 within slots 221, the relative spacing and orientation between modules 213 can be modified as needed by the user.

As a feature of the present invention, it should be noted that the spacing between modules 213 is only dependent upon the width of mounting plate 215. Accordingly, by increasing the width of mounting plate 215, modules 213 can be used in applications that require very wide needle spacing (e.g., large item packaging applications). By comparison, needle spacing for traditional single module fastener dispensing devices is significantly limited by the width of the device housing, thereby precluding its use in certain applications.

As another feature of the present invention, it should be noted that modules 213 for device 211 need not extend exclusively in a parallel relationship. Rather, the orientation of modules 213 can be modified, as desired, by adjusting the location of each slide 223 within slots 221. Furthermore, it is to be understood that by modifying the design of each slot 221 (e.g., to assume a U-shaped configuration), mounting plate 215 could be more suitably designed to allow for the arrangement of modules 213 in a wide variety of non-parallel configurations, which is of particular significance in certain applications (e.g., when securing larger items to display cards).

Rear surface 215-2 of mounting plate 215 is fixedly secured to a pair of spaced, apart, vertically disposed, L-shaped mounting brackets 229. In addition, a handle 231 is similarly fixedly secured to mounting brackets 229. As can be seen, handle 231 comprises a generally U-shaped frame 231-1 that is fixedly secured to mounting brackets 229 (e.g., by screws or other similar fastening elements) and a gripping rod 213-2 that extends laterally between the free ends of frame 231-1. In this capacity, it is to be understood that device 211 can be integrated into a wide variety of fastener dispensing environments by coupling mounting brackets 229 to one or more vertically displaceable elements. As a result, by pulling downward onto gripping rod 231-2, modules 213 can be drawn vertically downward so as to penetrate through one or more items to be fastened together, as will be described further in detail below.

In the present embodiment, modules 213-1 and 213-2 are represented as exact mirror images of one another. For simplicity purposes only, the following description focuses primarily on the details of right module 213-2. However, it is to be understood that left module 213-1 is preferably constructed as an exact mirror image of right module 213-2.

Figure 5:
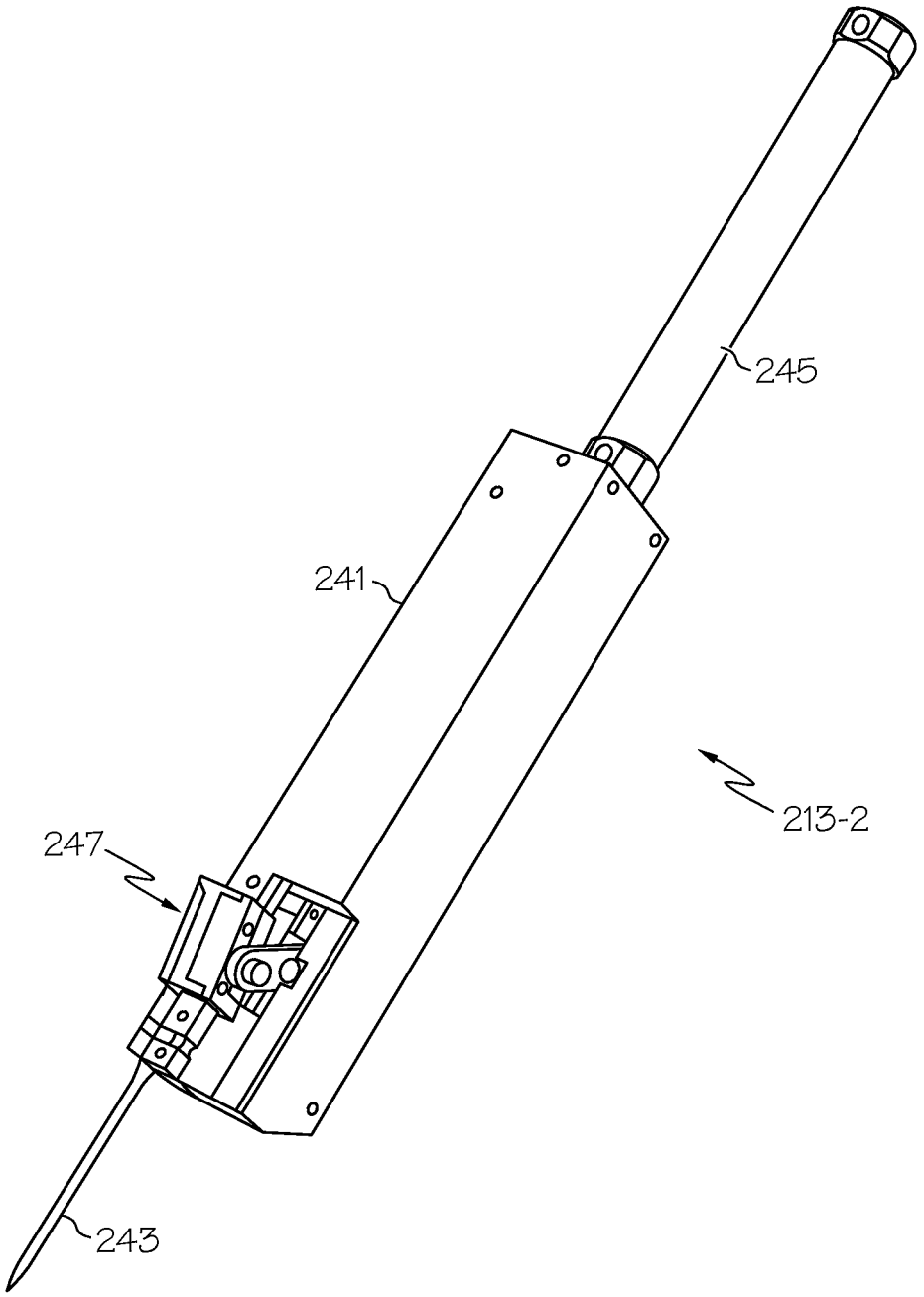
FIG. 5 is a front perspective view of the right side module shown in FIG. 4.
Figure 6:
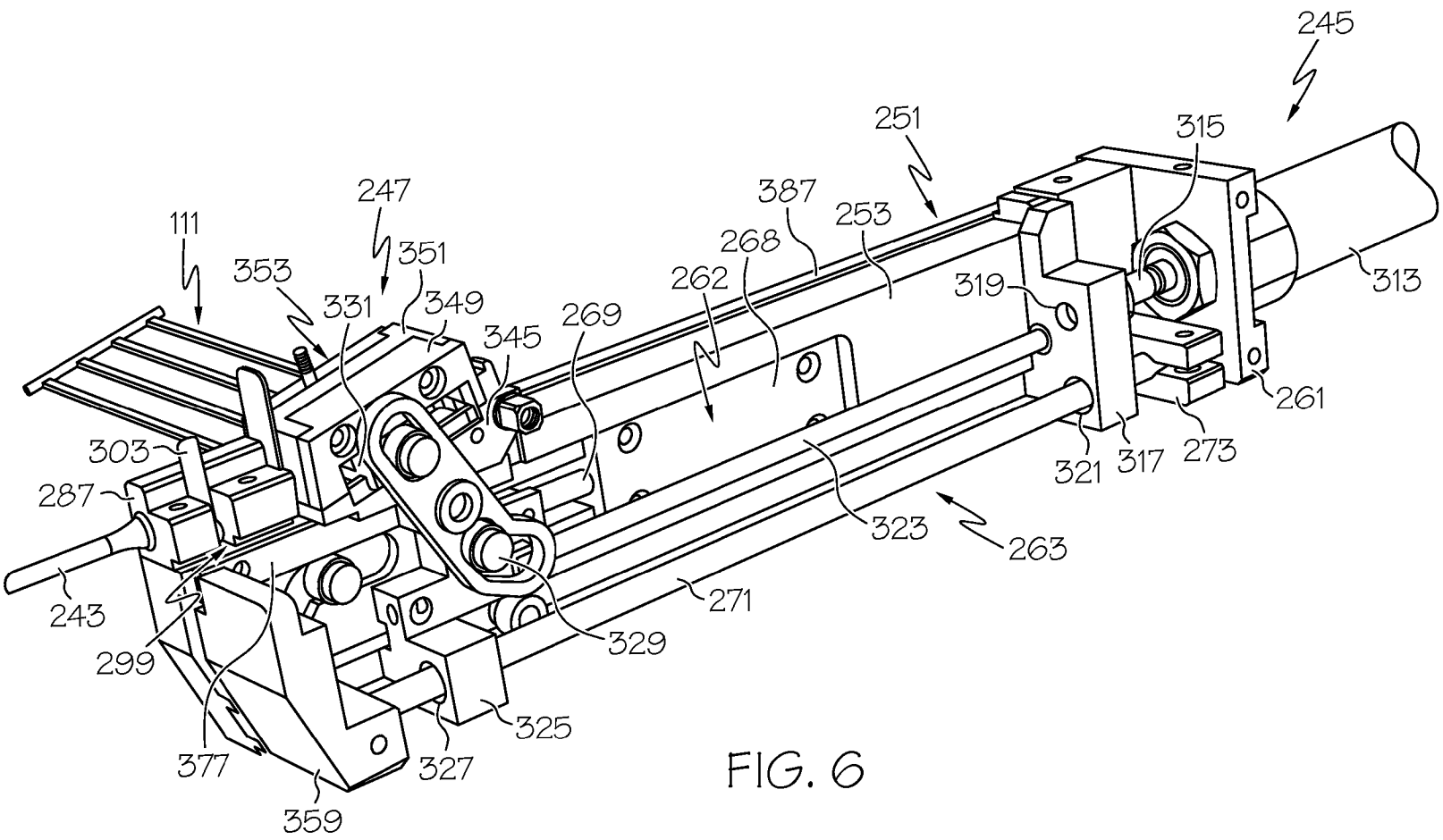
FIG. 6 is an enlarged, fragmentary, right side perspective view of the module shown in FIG. 5, the module being shown with portions of its housing removed therefrom, the module also being shown with the supply of continuously connected ladder stock of FIG. 2 fed thereinto.
Figure 7:
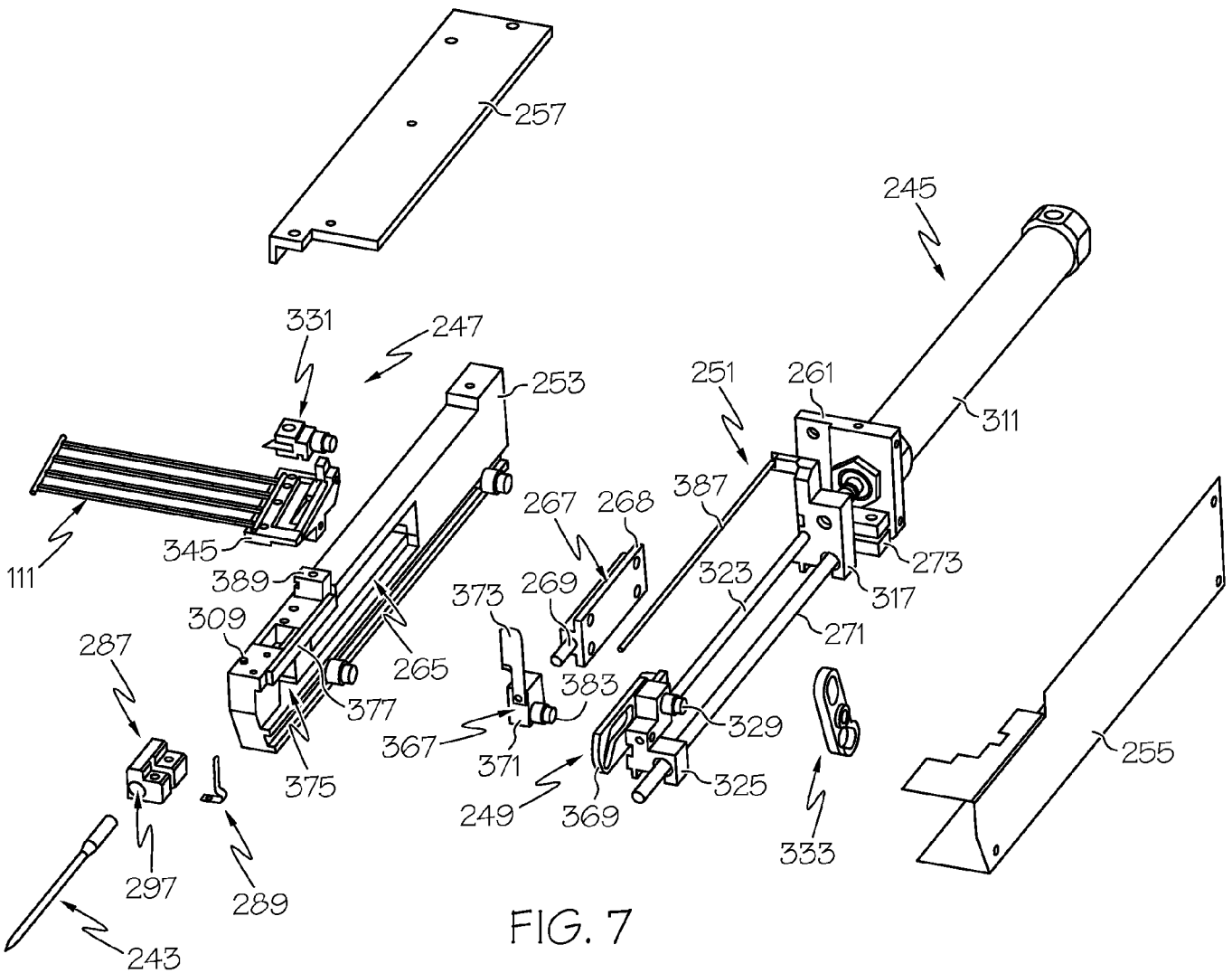
FIG. 7 is an exploded, front perspective view of selected components of the right side module shown in FIG. 5, the module being shown with the supply of continuously connected ladder stock of FIG. 2 fed thereinto.

Referring now to FIGS. 5-7, there are shown fully assembled, partially assembled, and exploded perspective views, respectively, of right module 213-2. As can be seen, module 213-2 comprises, inter alia, a generally enclosed housing 241, a needle 243 coupled to housing 241 that is adapted to penetrate through one or items to be fastened, a drive mechanism 245 for pneumatically powering the operation of module 213, a feed mechanism 247 for engaging the lowermost notch 125 in fastener stock 111 and advancing rail 113 into direct axial alignment behind needle 223, a severing mechanism 249 for cutting rail 113 at the midpoint between the two lowermost cross-links 117 and thereby separating an individual fastener 118 from fastener stock 111, and an ejection mechanism 251 for urging cross-bar 119 of severed fastener 118 out through hollowed needle 223.

Housing 241 is preferably constructed out a rigid and durable material, such as steel, and serves, inter alia, to protect the numerous internal components for module 213. As can be seen, housing 241 comprises a main chassis 253, a cover 255 that is generally L-shaped in transverse cross-section, a top enclosure plate, or bracket, 257, a front end support plate, or bracket, 259 and a rear end support plate, or bracket, 261 that are secured together at various locations by screws to together define a substantially enclosed interior cavity 263 that is dimensioned to receive selected mechanical components for module 213-2.

Main chassis 253 is shaped to define a recess 265 in its interior surface that is dimensioned to receive a spring piston 267. As seen most clearly in FIG. 6, spring piston 267 comprises a piston block 268 that is disposed within recess 265 and fixedly secured to main chassis 253 by screws (not shown). Piston 267 additionally includes a spring 269 protrudes outwardly from block 268 and applies continuous pressure onto selected internal components within module 213-2.

As seen most clearly in FIGS. 6 and 7, an elongated support axle 271 extends longitudinally through interior cavity 263, with one end of axle 271 being fittingly inserted into a corresponding interior bore formed in front end support plate, or nose, 259 and the opposite end of axle 271 being secured to the rear, interior surface of main chassis 253 by a generally U-shaped gripping element, or clamp, 273. As will be described further below, axle 271 not only provides structural support for housing 241 but also acts as a longitudinally extending shaft on which various mechanical components for module 213-2 slide.

Figure 8:
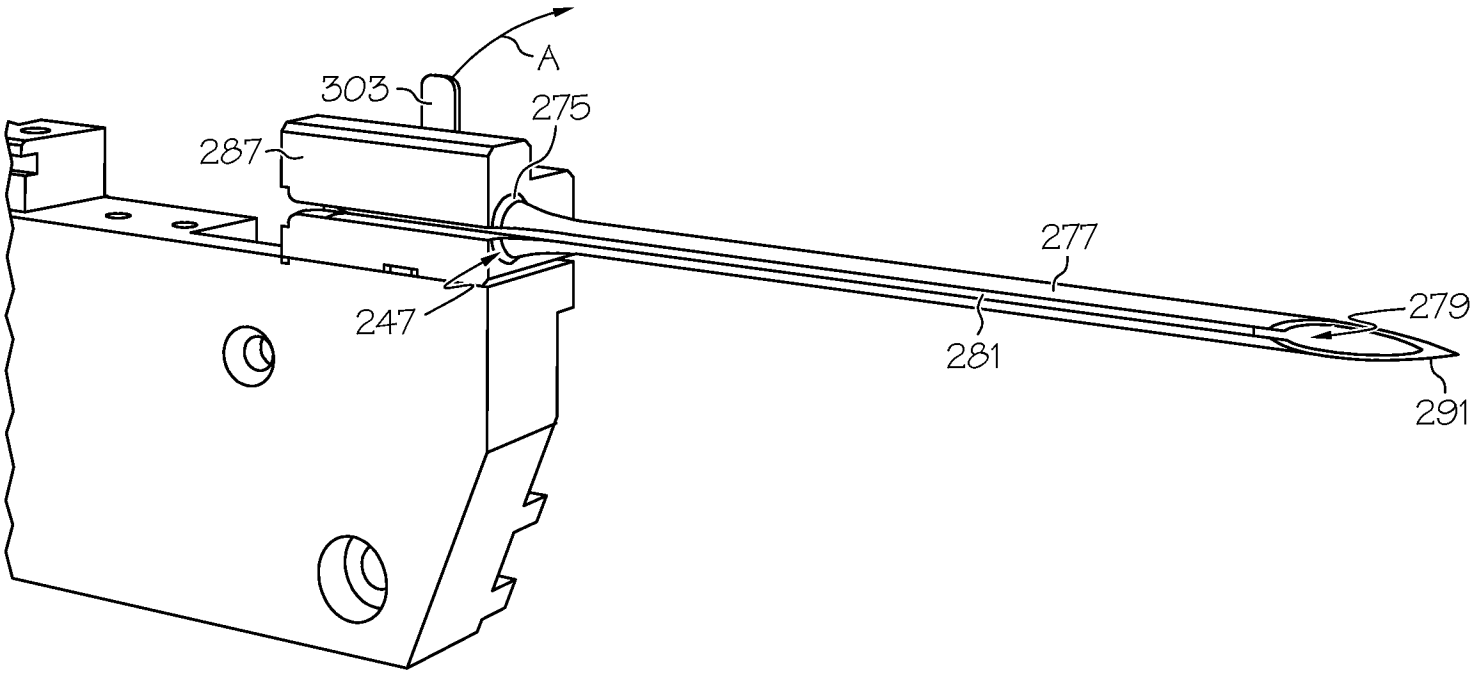
FIG. 8 is an enlarged, fragmentary left side perspective view of the main chassis, needle, needle holder and needle lock shown in FIG. 6.
Figure 9:
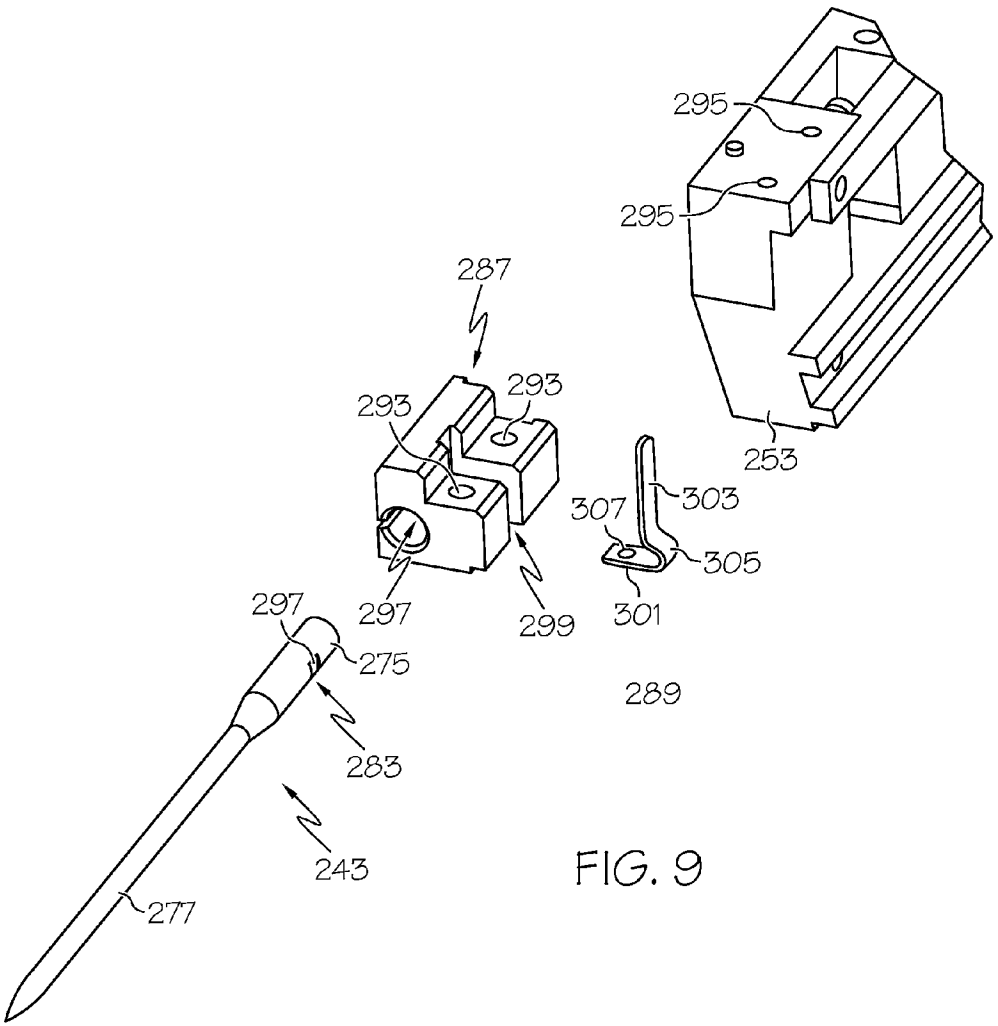
FIG. 9 is an exploded, fragmentary, front perspective view of the main chassis, needle, needle holder and needle lock shown in FIG. 8.

Referring now to FIGS. 6, 8 and 9, hollowed needle 243 includes an enlarged cylindrical base 275 and an elongated, hollowed stem 277 that extends out from the front of base 275 in a coaxial relationship relative thereto. Together, base 275 and stem 277 define a continuous longitudinal bore 279 that is dimensioned to fittingly receive rail 115 of fastener stock 111, with an inwardly facing longitudinal slot 281 being formed along the length of needle 223 through which cross-links 117 protrude.

As seen most clearly in FIG. 9, base 275 is shaped to define a generally rectangular transverse notch 283 in its rounded outer surface, with notch 283 extending inward so as to define a generally flat abutment surface 285. As will be described further below, the inclusion of notch 283 enables needle 243 to be retained within a complementary needle holder 287 using a hand-operable needle lock 289, which is highly desirable.

The free end of stem 277 is in the form of a spoon-shaped tip 291 that is sharpened to allow for its penetration through the items to fastened using device 211. As can be appreciated, bore 279 is slightly enlarged at tip 291, as shown in FIG. 8, to enable cross-bar 119 of severed fastener 118 to exit needle 223 during the fastener ejection process.

Needle holder 287 is constructed as a generally rectangular block that is shaped to include a pair of vertical thru-holes 293 that coaxially align with a corresponding pair of vertically-disposed threaded bores 295 formed in the front of main chassis 253. Accordingly, by driving a pair of screws (not shown) through holes 293 and into threaded engagement with bores 295, needle holder 287 can be fixedly mounted onto the front end of main chassis 259, as shown in FIGS. 6 and 8.

Needle holder 287 is additionally shaped to define a longitudinally extending, slotted receptacle 297 that is dimensioned to fittingly receive base 275 of needle 243. A transverse channel 299 extends partially through the middle of needle holder 287, channel 299 lying in communication with slotted receptacle 297 for reasons to become apparent below.

Needle 243 is releasably retained within receptacle 297 by manually-operable needle lock 289. As seen most clearly in FIG. 9, needle lock 289 is constructed as a unitary, L-shaped spring clip that includes a horizontal portion, or base, 301, a vertical portion, or finger, 303 and a curved intermediate portion 305. Base 301 is shaped to define a circular hole 307 that is dimensioned to fittingly receive an upwardly extending post 309 formed on the front end main chassis 253, thereby fixedly securing base 301 of needle lock 289 to main chassis 253. As seen most clearly in FIG. 6, needle lock 289 is configured such that finger 303 projects vertically through transverse channel 299 in needle holder 287 and into notch 283 (so as to abut against surface 285). In this capacity, needle lock 289 is designed to resiliently engage base 275 and thereby securely retain needle 243 in place within needle holder 287.

To remove needle 243 from needle holder 287 (e.g., for repair or replacement purposes), the user manually pivots the free end of finger 303 away from needle 243, as represented by arrow A in FIG. 8. While maintaining enough pressure on finger 303 so that needle lock 289 disengages from notch 283, the user is able to freely withdraw needle 243 from needle block 287. Once a new or repaired needle 243 is inserted back into receptacle 297, the spring-based construction of needle lock 289 resiliently returns finger 303 back into engagement within notch 299 upon removal of the manually applied pivot force. In this manner, it is to be understood that needle lock 289 is designed to be operated by hand and does not require the use of separate tools, which is an object of the present invention.

Referring back to FIGS. 6 and 7, drive mechanism 245 is provided to pneumatically power feed mechanism 247, severing mechanism 249 and ejection mechanism 251, as will be described in detail below. Drive mechanism 245 comprises a drive cylinder 311 that is externally mounted onto rear bracket 261, drive cylinder 311 comprising an externally disposed air chamber 313 that is coupled to compressed air supply 217 by hose 219-1. Although not shown herein, it should be noted that activation and deactivation of drive cylinder 311 is controlled through a valve assembly that can be actuated in any simplified manner (e.g., by hand or foot).

Drive cylinder 311 additionally includes a push rod 315 that is telescopingly mounted within air chamber 313 and adapted for axial displacement within interior cavity 263. A drive block, or carriage, 317 is mounted on the free end of push rod 315. Specifically, drive carriage 317 is shaped to include a transverse opening 319 that is sized and shaped to fittingly receive the free end of push rod 315, with an adhesive preferably deposited into opening 319 to secure carriage 317 on push rod 315. Carriage 317 is similarly shaped to include a transverse bore 321 through which support axle 271 penetrates. In this manner, the activation and deactivation of drive cylinder 311 serves to longitudinally displace push rod 315 and, in turn, move drive carriage 317 longitudinally back and forth along support axle 271 within interior cavity 263.

Figure 10:
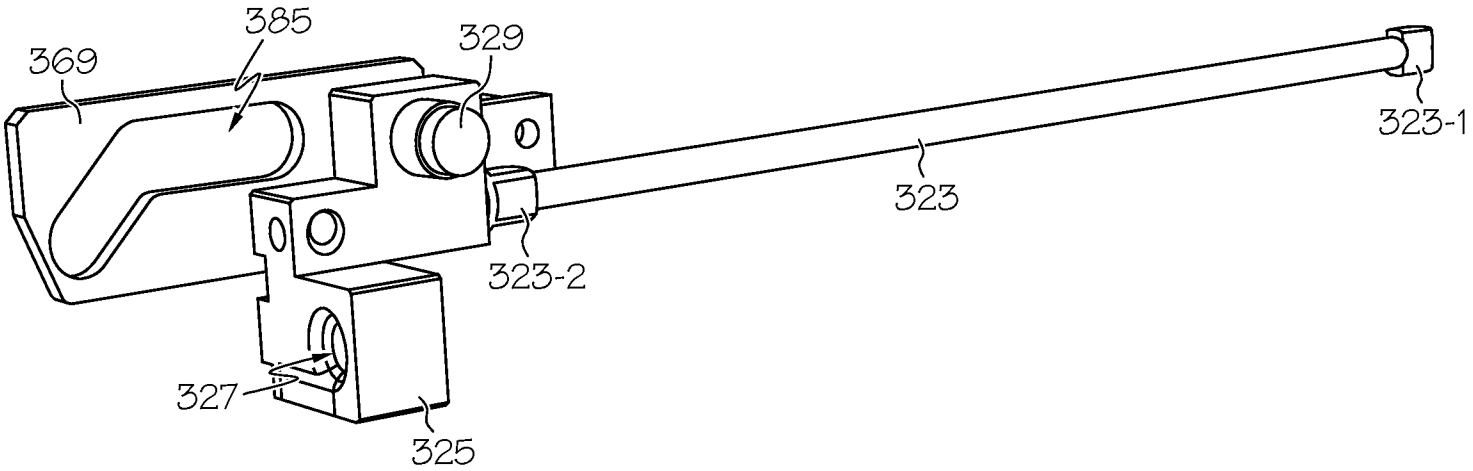
FIG. 10 is an enlarged, right side perspective view of the drive rod, drive slide and knife cam shown in FIG. 6.

Referring now to FIGS. 6, 7 and 10, an elongated drive rod 323 extends longitudinally within interior cavity 263 and includes a first end 323-1 that is releasably coupled to drive carriage 317 and a second end 323-2 that fixedly connected to a drive slide 325. As can be seen, drive slide 325 is constructed as a unitary, generally block-shaped member that is shaped to include a transverse bore 327 through which support axle 271 penetrates. Accordingly, it is to be understood that activation and deactivation of drive cylinder 311 serves to longitudinally displace drive carriage 317 and, in turn, move drive slide 325 back and forth along support axle 271, with support axle 271 limiting displacement of drive slide 325 to a linear path within interior cavity 263 (i.e., along a path parallel to the longitudinal axis of axle 271). In addition, a drive slide roller 329 is rotably mounted onto drive slide 325 and extends laterally outward therefrom, the function of roller 329 to become apparent below.

Figure 11:
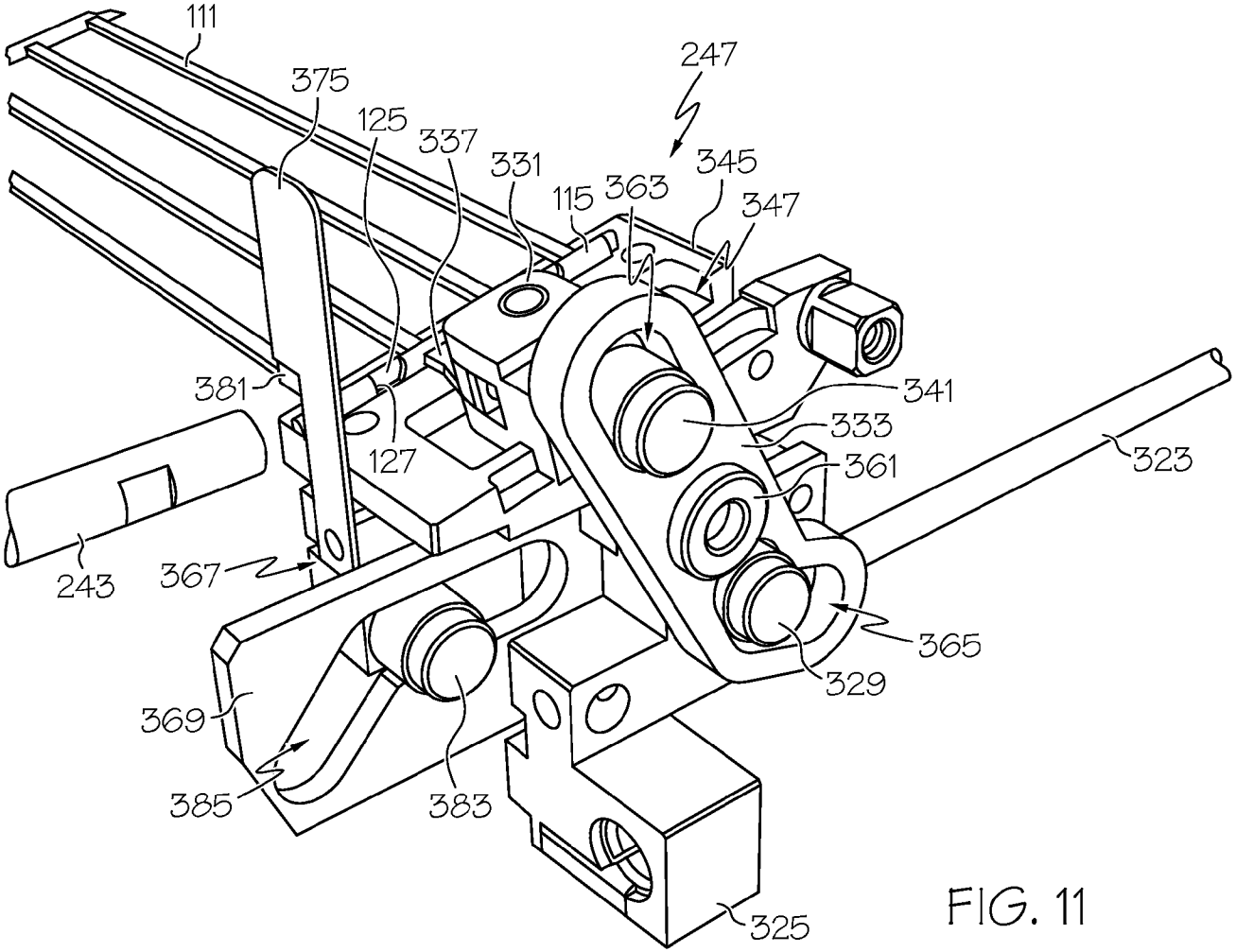
FIG. 11 is an enlarged, fragmentary, right side perspective view selected components of the module as shown in FIG. 5, the module being shown with the supply of continuously connected ladder stock of FIG. 2 fed thereinto.

Referring now to FIGS. 7 and 11, feed mechanism 247 comprises a feed pawl 331 that is coupled to drive slide 325 by an L-shaped feed pawl cam, or guideway, 333. In this manner, feed pawl 331 is driven by drive mechanism 245 to selectively engage fastener stock 111 and index the lowermost fastener 118 into position behind needles 243 for subsequent severing and ejection, as will be described further in detail below.

Figure 12:
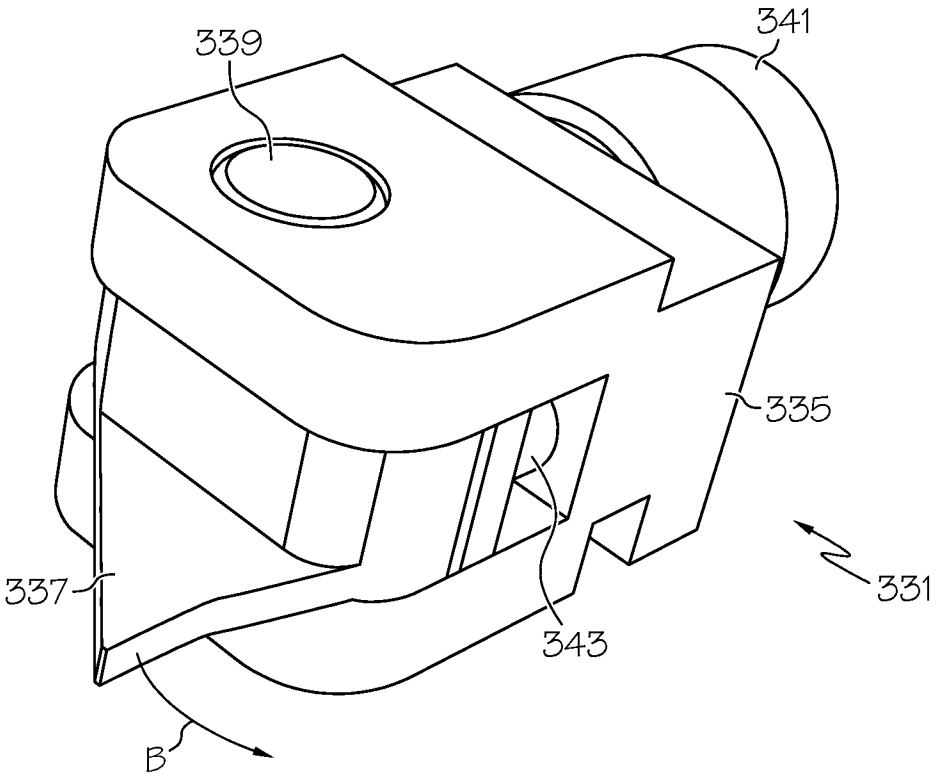
FIG. 12 is an enlarged left side perspective view of the feed pawl shown in FIG. 7.

Feed pawl 331, shown in isolation in FIG. 12, comprises a generally U-shaped feed pawl block, or bracket, 335 and a triangular engagement tooth 337 that is pivotally connected to bracket 335 by a transverse pivot pin 339. A feed pawl roller 341 is rotably mounted on the outer surface of bracket 335 and serves as a connection point for coupling feed pawl 331 to feed pawl cam 333, as will be described further in detail below.

Triangular engagement tooth 337 is disposed within the bifurcated end of bracket 335 and is resiliently biased outward (i.e., in the direction towards fastener stock 111) by a spring 343. It should be noted that tooth 337 is adapted to rotate about pin 339 in the counterclockwise direction (as represented by arrow B in FIG. 12) so as to compressing spring 343. In this manner, the tip of tooth 337 can be drawn in the direction away from fastener stock 111. Upon release of the pivot force applied to tooth 337, spring 343 resiliently biases tooth 337 in the clockwise direction and into engagement with fastener stock 111.

Figure 13:
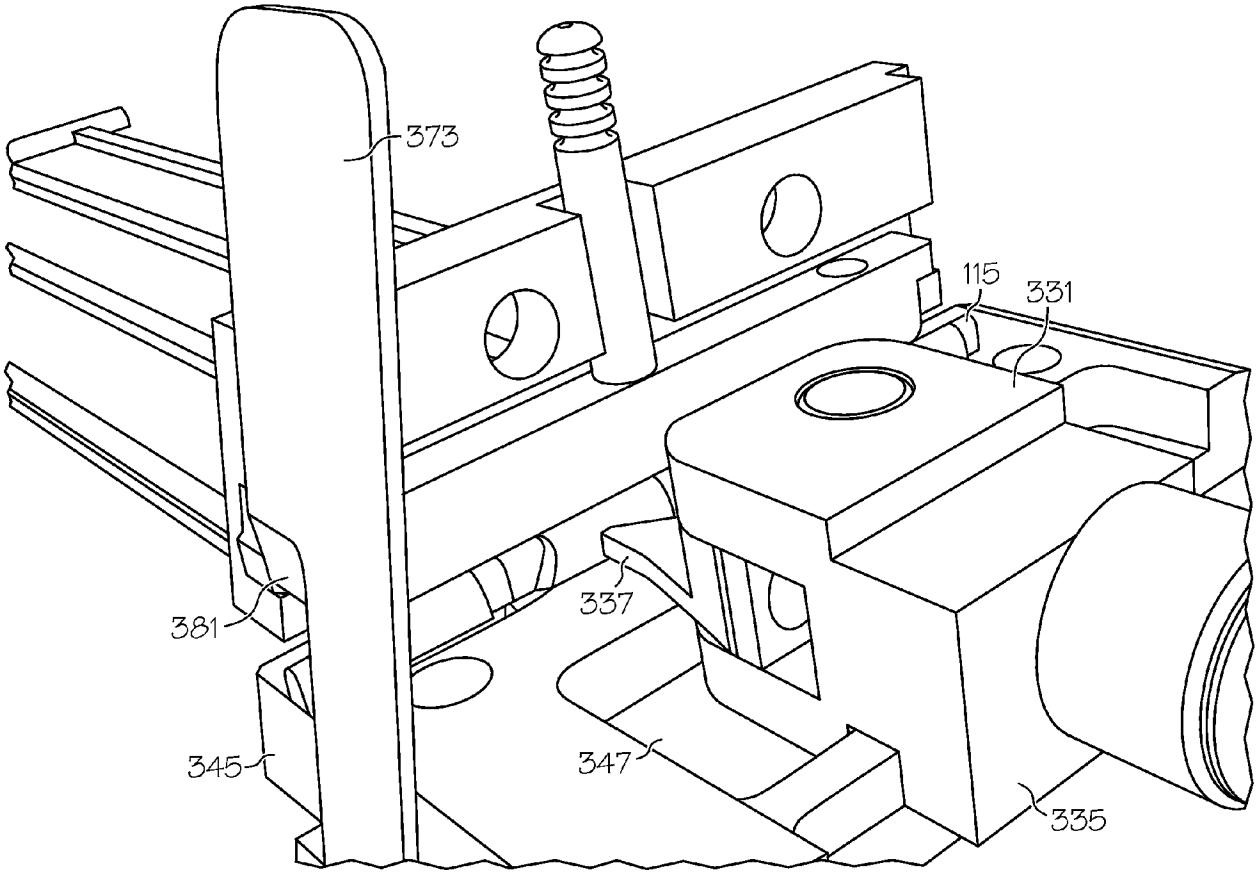
FIG. 13 is an enlarged, fragmentary, right side perspective view of the feed pawl, feed pawl slide, tension unit and knife blade shown in FIG. 6, the components being shown with the supply of continuously connected ladder stock of FIG. 2 fed thereinto.

Referring now to FIGS. 7, 11 and 13, feed pawl 331 is designed to travel along the top surface of a ramp-like feed pawl slide 345 that is fixedly mounted onto the top surface of main chassis 253, the front end of slide 345 being located directly behind the rear end of needle holder 287 in a slightly spaced apart relationship relative thereto. Top surface of feed pawl slide 345 is shaped to define a longitudinal recess, or channel, 347 that is dimensioned to receive the underside of bracket 335, with recess 347 limiting displacement of bracket 335 to a linear path. Accordingly, as will be described in detail below, feed pawl 331 is designed to selectively engage the lowermost notch 125 in rail 115 of ladder stock 111 and, in turn, index rail 115 into proper position behind needle 243 for subsequent severing and ejection processes.

Figure 14:
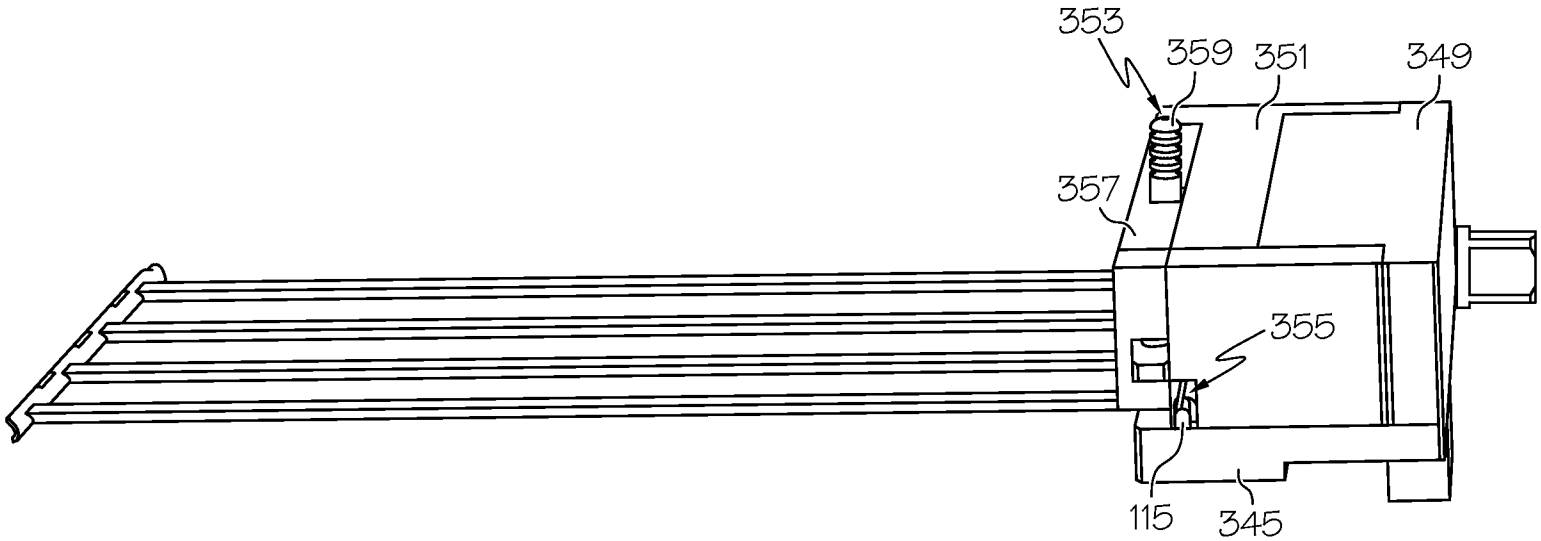
FIG. 14 is an enlarged, fragmentary, front perspective view of the feed slide, feed pawl cover, fastener retainer and tension unit shown in FIG. 6, the components being shown with the supply of continuously connected ladder stock of FIG. 2 fed thereinto.

As seen most clearly in FIGS. 6 and 14, a generally hollow feed pawl cover 349, a fastener retainer, or shroud, 351 and a tension unit 353 are arranged in a side-by-side relationship on top surface of slide 345 and are secured together by laterally driven fastening elements (not shown). In this manner, cover 349, retainer 351 and tension unit 353 together form a unitary block that is secured to slide 345.

Feed pawl cover 349 has an inverted U-shaped appearance in longitudinal cross-section and is mounted on slide 345 over feed pawl 331. In this capacity, it is understood that cover 349 serves to retain bifurcated bracket 335 in place within channel 347.

Fastener retainer, or shroud, 351 is fixedly secured to the top surface of slide 345 by a pair of vertically driven fastening elements (not shown). As seen most clearly in FIG. 14, the underside of retainer 351 is notched so as to define a narrow, longitudinal guide channel 355 that is generally rectangular in transverse cross-section. As can be appreciated, guide channel 355 is sized and shaped to receive rail 115 of fastener stock 111 and, in turn, guide rail 115 into position directly behind base 275 of needle 243 in coaxial alignment with longitudinal bore 279.

Tension unit 353 includes a hollowed tension bracket 357 that is fixedly secured to retainer 351 and a vertically movable tension block 359 that is disposed within an interior recess in bracket 357. Tension block 359 has an inverted T-shaped design and is adapted to selectively engage cross-links 117 on fastener stock 111. In this manner, by vertically displacing block 359 within bracket 357 the amount of frictional pressure applied to cross-links 117 by block 359 can be adjusted, thereby enabling the user to modify the feed tension for module 213-1 (i.e., the ease in which rail 115 glides through channel 355).

Referring back to FIG. 11, L-shaped feed pawl cam 333 is pivotally mounted to the side of slide 345 by a pivot screw (not shown), the pivot screw protruding through a central boss 361 in cam 333 and into threaded engagement within a lateral bore formed in slide 345. Feed pawl cam 333 is additionally shaped to include an upper slot 363 that is dimensioned to receive feed pawl roller 341 and a lower slot 365 that is dimensioned to receive drive slide roller 329. As a result, forward displacement of drive slide roller 329 within slot 365 ultimately causes feed pawl cam 333 to pivot in the clockwise direction which, in turn, pulls feed pawl 331 rearward. In a similar manner, rearward displacement of drive slide roller 329 within slot 365 ultimately causes feed pawl cam 333 to pivot in the counterclockwise direction which, in turn, urges feed pawl 331 forward.

Accordingly, it is to be understood that feed pawl 331 is designed to travel rearward within feed pawl channel 347 to a location just above the lowermost notch 125 in side rail 115, with tooth 337 pivoting in the counterclockwise direction to the extent necessary so that fastener stock 111 does not inhibit movement of feed pawl 331. Subsequent thereto, feed pawl 331 is designed to travel forward, with spring 343 resiliently urging the tip of tooth 337 clockwise into the lowermost notch 125 and firmly against engagement surface 127. As a result, as feed pawl 331 continues forward, tooth 337 engages fastener stock 111 and indexes rail 115 into direct axial alignment behind base 275 of needle 243.

Figure 15:
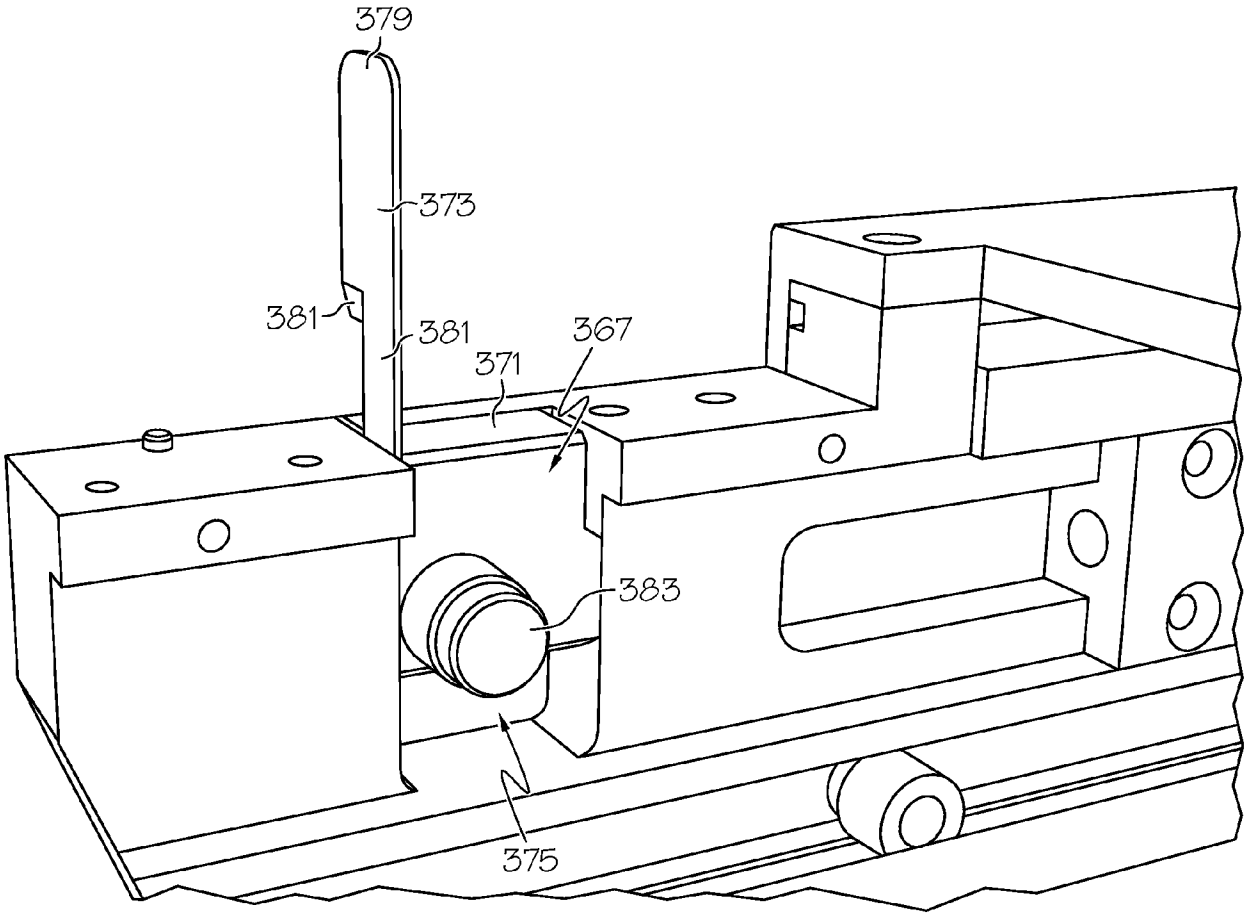
FIG. 15 is an enlarged, fragmentary, right side view of the knife blade assembly and main chassis shown in FIG. 6.

Referring now to FIGS. 7, 11 and 15, severing mechanism 249 comprises a blade assembly 367 that is coupled to drive slide 325 by a knife cam 369. As will be described further in detail below, blade assembly 367 is designed to be displaced vertically by drive mechanism 245 so as to sever rail 115 at the approximate midpoint between the two lowermost cross-links 117.

As seen most clearly in FIG. 15, blade assembly 367 comprises a block-shaped blade holder 371 and a vertically extending knife blade 373 that are coupled together by a rivet or other similar fastening element.

Blade holder 371 is fittingly received within a vertical recess 375 formed into the top surface of main chassis 253 directly behind needle holder 287. A rectangular retention bar 377 is connected to main chassis 253 and extends across recess 375 to permanently retain blade holder 371 within recess 375, as seen most clearly in FIGS. 6 and 7. As such, it is to be understood that blade holder 371 is limited to displacement within recess 375 along a vertical path, with protrusions on chassis 253 extending into recess 375 and thereby defining the range of vertical displacement.

Knife blade 373 is fixedly connected to the front surface of holder 371 (by rivet or other similar fastening element) and extends vertically upward therefrom, as shown in FIG. 15. Knife blade 373 includes an enlarged tab 379 that is connected to blade holder 371 by narrow connective arm 381, tab 379 including a sharpened cutting surface 381 along its bottom edge.

In addition, a knife roller 383 is rotably mounted on a side surface of blade holder 371. As will be described further in detail below, knife roller 383 serves as a connection point through which blade assembly 367 is coupled to drive mechanism 245.

As seen most clearly in FIG. 11, knife cam 369 is in the form of an elongated rectangular plate is fixedly coupled to the side of drive slide 325 at one end and projects out therefrom in the forward direction. Knife cam 369 is shaped to include a longitudinal slot 385 that is dimensioned to receive knife roller 383. As can be seen, slot 385 extends horizontally along the majority of its length and then angles sharply downward at its forward end.

As noted above, blade holder 371 is fittingly retained within recess 375 in main chassis 253 that limits its displacement along a vertical path. Furthermore, blade holder 371 is positioned directly behind the rear of needle 243 with cutting surface 381 disposed directly above rail 115, as shown in FIG. 11. Accordingly, it is to be understood that as knife cam 369 is pulled rearward by drive slide 325, knife roller 383 travels forward within slot 385. As knife roller 383 reaches the front of knife cam 369, the downward angle of slot 385 pulls knife blade 373 vertically downward, thereby drawing cutting surface 381 into contact against rail 115 of fastener stock 111, as will be described further in detail below.

Referring now to FIGS. 6 and 7, ejection mechanism 251 comprises an elongated, L-shaped ejector rod 387 that is fixedly coupled at one end to drive carriage 317 and extends longitudinally within interior cavity 263, with rod 387 being supported and held in position by a C-shaped guide block 389 formed on the top surface of main chassis 253. The free end of ejector rod 387 is disposed in coaxial alignment with bore 279 in needle 243 has well as guide channel 355 and receptacle 297 in needle holder 287). Accordingly, it is to be understood that forward displacement of drive carriage 317 within interior cavity 263 causes the free end of ejector rod 387 to axially penetrate through bore 279 in needle 243 and, in turn, expel cross-bar 121 of severed fastener 118 out through sharpened tip 291.

As a principal feature of the present invention, device 211 is designed so that ejection mechanisms 251 for modules 213-1 and 213-2, respectively, operate independently of one another. In particular, device 211 is configured so that the pair of ejector rods 387 penetrates through their corresponding needles 243 in an offset, or staggered, relationship. As will be described further below, the offset relationship between the pair of ejector rods 387 reduces the stress imparted onto fastener 118 during the dispensing process.

It is to be understood that inherent imperfections in the delivery of air from source 217 to the pair of drive cylinders 311 will cause ejector rods 387 to penetrate through needles 243 in an offset, or out-of-phase, relationship. However, it should be noted that various design implementations could be applied to device 211 to ensure offset penetration of needles 243 by the pair of ejector rods 387. Examples of means to ensure offset penetration of needles 243 include, but are not limited to, adjusting the speed of each of the pair of air cylinders 331, modifying the position and/or length of each of the pair of ejector rods 387, and or changing the size and/or length of the pair of hoses 219 (i.e., to unevenly deliver compressed air to cylinders 331).

It is also to be understood that the novel offset ejection process described in detail above could be similarly implemented in a fastener dispensing device that consists of a single module. For example, a single air cylinder could be utilized to drive a single drive carriage. However, a pair of ejector rods could be mounted onto the common drive carriage in an offset relationship (e.g., by using ejector rods that differ in length). Accordingly, as the drive carriage advances within the device housing, the free ends of the pair of ejector rods would penetrate through the corresponding pair of needles in an offset relationship.

Operation of Fastener Dispensing Device 211

Referring back to FIG. 4, fastener dispensing device 211 can be used in the following manner to separate a plastic fastener 118 from ladder stock 111 and, in turn, drive the separated fastener 118 through at least one item. As a preparatory step, modules 213 for device 211 are first arranged in the optimal configuration for the intended application. In particular, device 211 is optimized for use by adjusting both the spacing and the angular relationship between modules 213 (i.e., by loosening slides 223, moving modules 213 within tracks 221, and then re-tightening slides 223).

Having disposed modules 213 in the ideal configuration for the intended application, rails 113 and 115 of fastener stock 111 are fed into feed channels 355-1 and 355-2, respectively. With the lowermost segment of rails 113 and 115 disposed in direct axial alignment behind needles 243-1 and 243-2, device 211 is then activated by the user (e.g., through the depression of a foot pedal or the like).

Figure 16A:
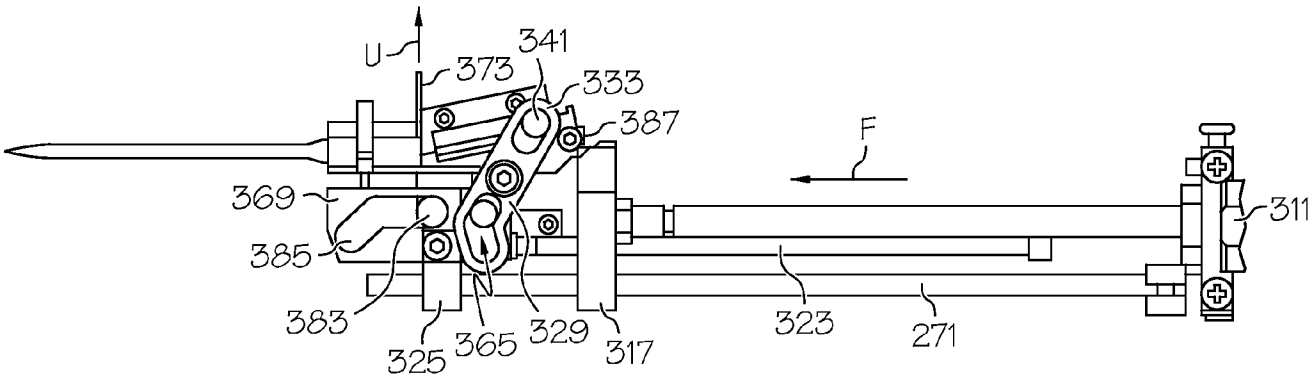
FIGS. 16(*a*)-(*c*) are right side views of selected components of the module shown in FIG. 6 at various stages during the fastener dispensing process.
Figure 16B:
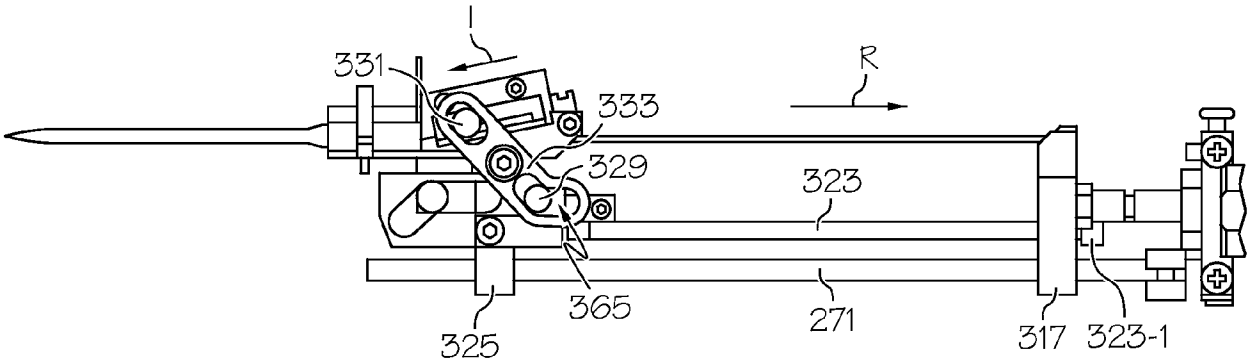
Figure 16C:
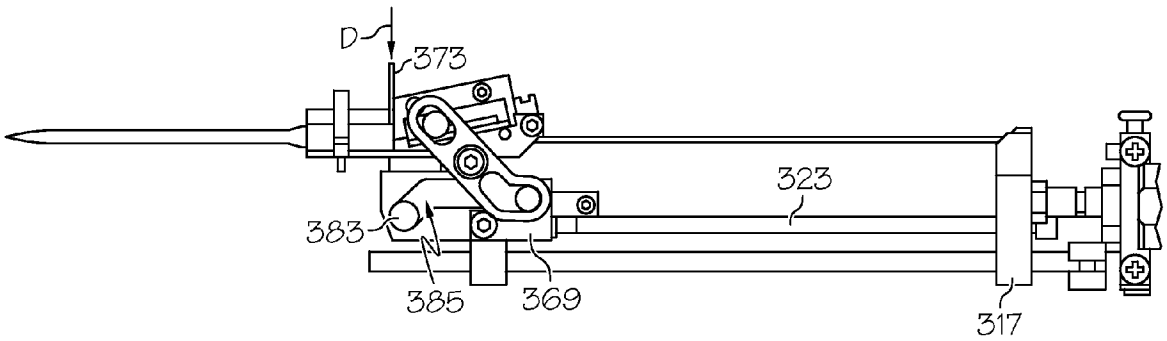

Referring now to FIGS. 16(*a*)-(*c*), upon activation of drive cylinder 311 for each module 213 (e.g., by a hand or foot activated valve), each carriage 317 slides in the forward direction F and travels axially along the length of both drive rod 323 and support axle 271, as shown in FIG. 16(*a*). As a result, each carriage 317 drives its ejector rod 387 axially through longitudinal bore 279 in its corresponding needle 243, thereby ejecting any fasteners 118 separated from fastener stock 111.

At the same time, it is to be understood that each spring piston 267 applies continuous pressure against the rear of its corresponding drive slide 325 so as to maintain drive slide 325 in its most forward position. As can be appreciated, the forward position of each drive slide 325 similarly disposes its knife cam 369 in its most forward position. With each knife cam 369 positioned as such, its corresponding knife roller 383 is located the most rearward position within slot 385. Due to the particular shape of slot 385, the rearward position of knife roller 383 within slot 385 disposes cutting edge 381 of knife blade 373 vertically upward and away from fastener stock 111, as represented by arrow U in FIG. 16(*a*).

In addition, the forward position of each drive slide 325 similarly causes drive slide roller 329 to locate within the forward portion of slot 365 in feed pawl cam 333. As a result, feed pawl cam 333 disposes its feed pawl 331 slightly above the lowermost notch 125 in its corresponding rail of fastener stock 111.

At this point during the operation cycle for each module 213, its corresponding carriage 317 commences is rearward stroke and travels axially along the length of both drive rod 323 and support axle 271, the rearward displacement being represented by arrow R in FIG. 16(*b*). Ultimately, each carriage 317 contacts and grabs the enlarged first end 323-1 of its corresponding drive rod 323. Because the rearward force applied by carriage 317 onto drive rod 323 is greater than the forward force applied thereto by spring piston 267, each drive rod 323 is pulled rearward by its first end 323-1 which, in turn, displaces drive slide 325 rearward.

The rearward displacement of each drive slide 325 causes its drive slide roller 329 to travel rearward within slot 365 which, in turn, causes feed pawl cam 333 to pivot in the counterclockwise direction. The counterclockwise rotation of feed pawl cam 333 indexes (i.e., advances) feed pawl 331 forward, as represented by arrow I in FIG. 16(*b*). As each feed pawl 331 is advanced forward, its finger 337 spring biases into engagement with the lowermost notch 125 and, in turn, indexes its respective side rail of fastener stock 111 into position behind its corresponding needle 243.

With fastener stock 111 now advanced into its proper position, further rearward displacement of each drive rod 323 pulls its knife cam 369 rearward until its knife roller 383 moves forward within slot 385 which, in turn, pulls its knife blade 373 downward, as represented by arrow D in FIG. 16(*c*). This downward displacement of each knife blade 373 ultimately severs the lowermost fastener 118 from ladder stock 111, thereby completing the rearward stroke for drive cylinder 311.

As each drive carriage 317 commences its second forward stroke, as shown in FIG. 16(*a*), its corresponding ejector rod 387 similarly advances forward and axially penetrates through the longitudinal bore 279 in its corresponding needle 243. In this capacity, the pair of ejector rods 387 serves to eject cross-bars 119 and 121 of severed fastener 118 out through the pair of hollowed needles 243. At the same time, spring piston 267 resiliently moves drive slide 325 back to its most forward position for further indexing and severing of ladder stock 111.

Figure 17:
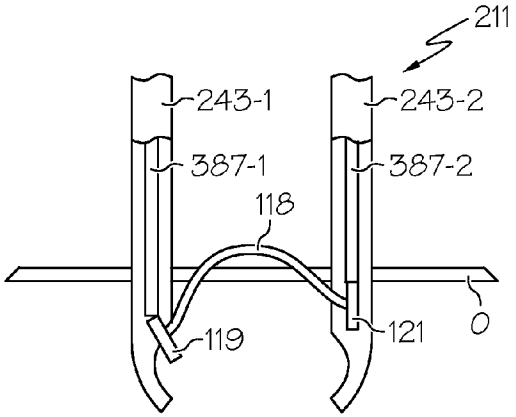
FIG. 17 is a fragmentary, front view, broken away in part, of the device shown in FIG. 4, the device being shown dispensing a plastic fastener through an object, the object being shown in section for simplicity purposes only.

As a feature of the present invention, the pair of ejector rods 387 are independently driven (i.e., each ejector rod 387 is driven by its own drive cylinder 311 that is independently coupled to air supply 217). As noted briefly above, ejector rods 387 penetrate through needles 243 in an offset, or out-of-phase, relationship to limit stress on each fastener 118 during the ejection process. Specifically, referring now to FIG. 17, there is shown a simple rendering of device 211 being used to eject an individual fastener 118 through an object O. In the present example, drive cylinder 225-1 operates faster than the other drive cylinder 225-2 (e.g., as a result of intentional adjustments to device 211 or inherent imperfections in the delivery of air). As a result, ejector rod 387-1 first pushes cross-bar 119 out through open tip of needle 243-1, as represented in FIG. 17. Once completed, ejector rod 387-2 then pushes cross-bar 121 out through open tip of needle 243-2. Accordingly, the temporary stretching force applied to fastener 118 during the ejection process is staggered, or offset, thereby limiting the maximum stress level imparted onto fastener 118 and, as a consequence, the risk of fastener breakage, which is a principal object of the present invention.

As defined herein, use of the term "offset" denotes that each of cross-bars 119 and 121 is ejected out of its corresponding needle 243 in an out-of-phase relationship. In other words, cross-bars 119 and 121 do not eject from needles 243 at the same time.

Applications for Fastener Dispensing Device 211

Figure 18:
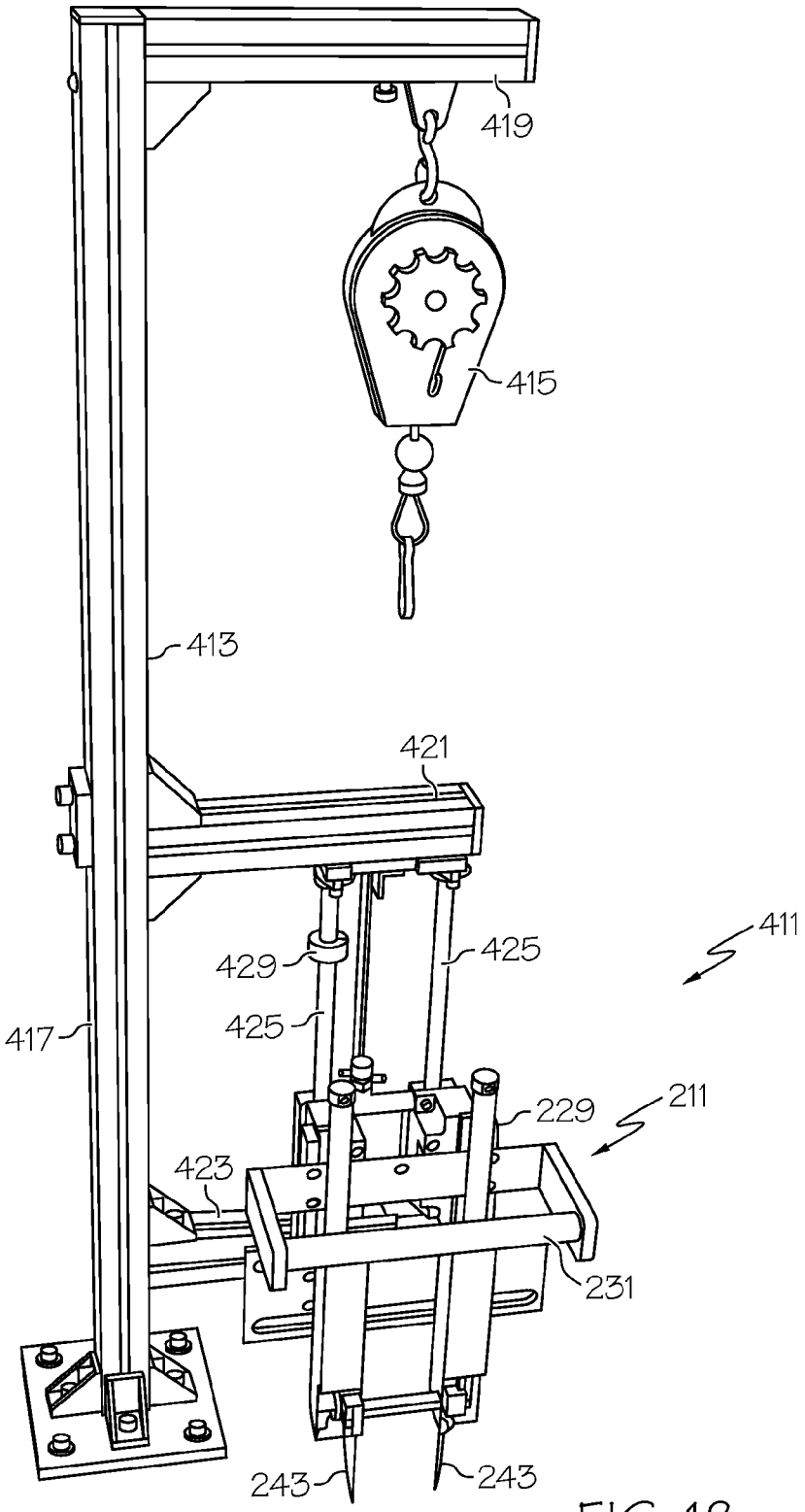
FIG. 18 is a front perspective view of a fastener dispensing system constructed according to the teachings of the present invention.

As noted above, fastener dispensing device 211 can be integrated into a wide variety of fastener dispensing environments by coupling mounting brackets 229 to one or more vertically displaceable elements. For example, referring now to FIG. 18, there is shown a fastener dispensing system constructed according to the teachings of the present invention, the fastener dispensing system being identified generally by reference numeral 411.

As can be seen, fastener dispensing system 411 comprises fastener dispensing device 211, a mounting stand 413 on which fastener dispensing device 211 is slidably coupled and a counterbalance 415 secured to mounting stand 413 for supporting device 211.

Mounting stand 413 represents any stand that can be used to hold fastener dispensing device 211 and allow displacement thereof along a defined vertical path. For example, mounting stand 413 may be of the type described in U.S. Pat. No. 6,732,899 to J. R. Franks, the disclosure of which is incorporated herein by reference. Specifically, mounting stand 413 includes a vertical beam 417 that is adapted to be secured to a workstation or other similar surface as well as upper, intermediate and lower legs 419, 421 and 423, each of which is secured at one of its ends to vertical beam 417.

As can be seen, upper horizontal leg 419 supports counterbalance 415. In this manner, counterbalance 415 can be tethered to fastener dispensing device 211 to resiliently urge device 211 upward. As such, upon release of handle 213, sharpened needles 243 are lifted up and away from the workspace for safety purposes.

A pair of spaced apart, parallel shafts 425 extends vertically between intermediate and lower legs 421 and 423. A ball bearing mount (not shown) is coupled to each shaft 425 and is capable of being axially slid thereon. Accordingly, by coupling brackets 229 to the pair of ball bearing mounts, stand 413 limits displacement of device 211 along a linear path displacement, with optional collars 429 mounted on shafts 425 to limit the range of vertical displacement.

In use, system 411 can be used in the following manner to dispense plastic fasteners 118 from supply of fastener stock 111. Specifically, the desired articles to be secured together with fastener 118 are preferably disposed on an anvil (not shown) or other similar flat support surface that is disposed directly beneath needles 243. With a supply of fastener stock 111 loaded into device, 211, handle 231 is grasped and displaced vertically downward until needles 243 penetrate through the desired articles. At that time, the user activates the pneumatic operation of device 211 which, in turn, dispenses a plastic fastener 118 through the articles. Once completed, withdrawal of handle 231 causes device 211 to be retracted upward by counterbalance 415 until future use is required.

It will thus be seen according to the present invention that a highly advantageous fastener dispensing device and fastener stock for use in conjunction therewith has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

What is claimed is:

1. A device for dispensing a plastic fastener, the plastic fastener including a pair of cross-bars that are interconnected by at least one thin filament, the device comprising:

(a) a first needle shaped to define a longitudinal bore;

(b) a first ejector rod adapted to axially penetrate through the longitudinal bore in the first needle and eject one of the pair of cross-bars out therefrom;

(c) a second needle shaped to define a longitudinal bore; and (d) a second ejector rod adapted to axially penetrate through the longitudinal bore in the second needle and eject the other of the pair of cross-bars out therefrom;

(e) such that the first ejector rod and the second ejector rod are separate from one another and operate using independent ejection mechanisms and the first and second ejector rods operate in an offset relationship.

2. The device as claimed in claim 1, the device further comprising:

(a) a first module adapted to dispense one of the pair of cross-bars for the fastener, the first module including;

(i) a housing shaped define an interior cavity;

(ii) a feed mechanism adapted to advance one of the continuous side rails into direct axial alignment behind the longitudinal bore of the needle;

(iii) a severing mechanism adapted to cut the one of the continuous side rails to separate a first cross-bar therefrom; and (b) a second module adapted to dispense the other of the pair of crossbars having an ejection mechanism separate from the ejection mechanism for the first module.

3. The device as claimed in claim 2 wherein the feed mechanism, severing mechanism and ejection mechanism of the first module are coupled to a common drive mechanism.

4. The device as claimed in claim 3 wherein the feed mechanism is adapted to selectively engage the one of the continuous side rails.

5. The device as claimed in claim 4 wherein the feed mechanism comprises a feed pawl coupled to the drive mechanism, the feed pawl comprising:

(a) a feed pawl bracket;

(b) a tooth pivotally connected to the feed pawl bracket; and (c) a spring connecting the tooth to the feed pawl bracket, the spring resiliently urging the tooth into selective engagement with the one of the continuous side rails.

6. The device as claimed in claim 5 wherein the feed mechanism further comprises a feed pawl slide fixedly coupled to the housing the feed pawl slide having a top surface that is shaped to include a recess that is dimensioned to receive at least a portion of the feed pawl bracket.

7. The device as claimed in claim 1 wherein the first and second needle each comprise:

(a) an enlarged cylindrical base; and (b) an elongated hollow stem that extends out from the base in a coaxial relationship relative thereto, the base and the stem together defining the continuous longitudinal bore;

(c) wherein the base is shaped to define a notch in its outer surface.

8. The device as claimed in claim 7 wherein the notch is generally rectangular in transverse cross-section and defines a flat abutment surface in the base.

9. The device as claimed in claim 8 further comprising a needle holder coupled to the housing, the needle holder being shaped to define a slotted receptacle dimensioned to receive the base of either the first or second needle and a transverse channel in communication with the slotted receptacle.

10. The device as claimed in claim 9 further comprising at least one needle lock that includes a first end fixedly coupled to the housing, a second end that is externally accessible and an intermediate portion that is adapted to project into the channel in the needle holder and selective engage the notch in either the first or second needle.

11. The device as claimed in claim 1 wherein the first and second ejector rods are independently driven.

* * * * *